US006815381B1

(12) United States Patent
Yamamoto et al.

(10) Patent No.: US 6,815,381 B1
(45) Date of Patent: Nov. 9, 2004

(54) FIBROUS MATERIAL, PRODUCTION PROCESS OF THE FIBROUS MATERIAL, INK-ABSORBING, TREATING PROCESS OF THE INK-ABSORBING MEMBER, INK TANK CONTAINER AND INK CARTRIDGE

(75) Inventors: Hajime Yamamoto, Yokohama (JP); Eiichiro Shimizu, Yokohama (JP); Yoshihisa Takizawa, Machida (JP); Keiichiro Tsukuda, Kawasaki (JP); Yuji Hamasaki, Kawasaki (JP); Jun Hinami, Kawasaki (JP); Mikio Sanada, Yokohama (JP); Hiroki Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/132,746

(22) Filed: Aug. 12, 1998

(30) Foreign Application Priority Data

Aug. 18, 1997 (JP) ..... 9-221648

(51) Int. Cl.[7] ..... D03D 15/00

(52) U.S. Cl. ..... 442/187; 442/333; 442/401; 442/414; 428/394; 347/86; 347/87

(58) Field of Search ..... 428/394; 442/187, 442/333, 414, 401; 347/86, 87

(56) References Cited

U.S. PATENT DOCUMENTS

| | | | | |
|---|---|---|---|---|
| 4,245,004 | A | 1/1981 | Login et al. | 428/394 |
| 5,509,140 | A | 4/1996 | Koitabashi et al. | 347/86 |
| 5,567,373 | A | 10/1996 | Sato et al. | 264/112 |
| 5,619,239 | A | 4/1997 | Kotaki et al. | 347/86 |
| 5,742,311 | A | 4/1998 | Koitabashi et al. | 347/86 |
| 5,784,088 | A | 7/1998 | Ujita et al. | 347/86 |
| 5,815,184 | A | 9/1998 | Ujita et al. | 347/89 |
| 6,234,618 | B1 * | 5/2001 | Yamamoto et al. | 347/86 |

FOREIGN PATENT DOCUMENTS

| | | |
|---|---|---|
| EP | 562733 | 9/1993 |
| EP | 691207 | 1/1996 |
| EP | 743185 | 11/1996 |
| EP | 771662 | 5/1997 |
| GB | 766384 | 1/1957 |
| GB | 2059975 | 4/1981 |
| JP | 64-4350 | 1/1989 |
| JP | 4-348947 | 12/1992 |
| JP | 8-020115 | 1/1996 |
| JP | 8-020155 | 1/1996 |
| JP | 8-310011 | 11/1996 |
| JP | 9-109410 | 4/1997 |
| LU | 35672 | 12/1957 |

OTHER PUBLICATIONS

K. Bauer, "Manufacturing Yarn and Fibre", The Textile Institute: Polyester 50 Years Of Achievement, Great Britain, pp. 64–67.

B. Von Falkai, "Synthesefasern; Grundlagen, Technologi, Verarbeitung und Anwendung", 1981, Verlag Chemie, Weinheim, DE, pp. 173.

* cited by examiner

*Primary Examiner*—Terrel Morris
*Assistant Examiner*—John J. Guarriello
(74) *Attorney, Agent, or Firm*—Fitzpatrick, Cella, Harper & Scinto

(57) ABSTRACT

Disclosed herein is a process for producing a fibrous material for a member with which an ink-jet ink comes into contact, including the step of melt spinning a thermoplastic resin, the process comprising the step of treating a spun yarn by bringing it into contact with a glycol added with ethylene oxide.

75 Claims, 15 Drawing Sheets

FIBROUS MATERIAL, PRODUCTION PROCESS OF THE FIBROUS MATERIAL, INK-ABSORBING, TREATING PROCESS OF THE INK-ABSORBING MEMBER, INK TANK CONTAINER AND INK CARTRIDGE

BACKGROUND OF THE INVENTION

1. Field of the Invention

The present invention relates to a fibrous material suitable for members used in contact with an ink, a fiber mass formed with the fibrous material, an ink tank containing the fiber mass therein, an ink-jet apparatus using the fiber mass as at least a part of its members with which an ink comes into contact, and a production process of the fibrous material.

2. Related Background Art

In ink tanks [including an ink tank portion of an ink-jet cartridge integrally formed together with an ink-jet head (recording head)] used in ink-jet (recording) apparatus, a member called an ink-absorbing member, which serves to absorb and hold an ink therein and supply the ink to a head as needed, is generally used. In one form of ink-jet cartridges and the like, in which an ink tank thereof is detachably installed in a cartridge, and the ink tank alone is replaced when an ink contained in the ink tank has been consumed, an ink-absorbing member having a joint function that strong capillary force is generated at a joint surface with a recording head to collect the ink within the ink tank there and supply it to the head, i.e., a joint member, may also be used at the same time in some cases.

As the ink-absorbing member accommodated in an ink chamber, a spongy member composed of, for example, a urethane polymer is known, while a member composed of, for example, polyethylene, polyethylene terephthal ate or the like is known as the joint member.

Since the ink-jet head has a precise structure and tends to cause ejection failure due to inclusion of dust, dirt and/or the like, it is also conducted to provide a filter at a proper position in an ink flow path in order to prevent the ejection failure.

As such ink-absorbing members (including joint members) or filters, those of various materials and forms are tried. As one of them, it is known that a fibrous material is molded at a predetermined density to attain an ink-absorbing function, joint function or filtering function making good use of spaces defined among fibers of the fibrous material.

In order to allow a molding from a fibrous material to function as an absorbing member for ink-jet inks, it is required that the ink can be effectively received by capillary force in spaces defined among fibers of the fibrous material when molded into the molding, and at the same time the spaces among the fibers are surely retained to hold the ink therein even after the ink has been charged, and that the ink can be smoothly supplied to an ink-jet head connected to the absorbing member when the pressure on the side of the head is reduced by ejection of the ink. For example, Japanese Patent Application Laid-Open No. 8-310011 discloses that a nonwoven fabric, in which a relationship between surface tension and electric conductivity satisfies a specified equation, is used as an ink-absorbing member. Japanese Patent Application Laid-Open No. 8-20115 discloses that arrangement of elastic fibers within an ink chamber of an ink tank is adjusted to surely retain spaces among the fibers, thereby allowing a molding composed of a fibrous material to function as an ink-absorbing member.

Further, a fibrous material itself requires that any component, which proves to be unfavorable to an ink itself and for the ejection of the ink from an inkjet head, is not dissolved out therefrom upon contact with the ink, or if any, its amount is reduced to an extent that such unfavorableness is not caused.

For example, Japanese Patent Application Laid-Open No. 4-348947 discloses that an ink-absorbing member composed of a urethane polymer is washed with a polar solvent in advance to dissolve and remove nonvolatile components, thereby holding down the amount of components dissolved out upon contact with an ink to at most 0.04% by weight based on the weight of the ink.

Japanese Patent Application Laid-Open No. 64-4350 has as its object the solution of a problem that additives such as metal salts of stearic acid dissolve out in an ink from a resin or synthetic rubber from which an ink tank for storing the ink is formed, and discloses the provisions of sodium ion concentration in an ink to be stored as a means for solving such a problem. However, this publication does not refer to an absorbing member for holding the ink, in particular, an absorbing member to which a fibrous material is applied, to say nothing of the production process of the fibrous material.

The present inventors have carried out an investigation in which a filamentous fibrous material of a polyolefin rein disclosed in Japanese Patent Application Laid-Open No. 8-20115 is changed to a multifilamentous fibrous material having higher productivity, or replaced by a staple fiber material, with a view toward more reducing the cost of ink-absorbing members used for ink tanks for inkjet. As a result, it has been found that the mere limitation of variation in the ratio of a surface tension to an electric conductivity before and after washing with water disclosed in Japanese Patent Application Laid-Open No. 8-310011 does not suffice materials for ink-absorbing members, and such a material may rather adversely affect printing performance in some cases.

The first cause thereof is that although attached substances which may be washed out with water have been removed from a fiber mass by washing, a part of such substances still remain in the fiber mass without being washed out. Namely, it has been found that the fact that "the ratio of the surface tension to the electric conductivity does not change even after washing" referred to in Japanese Patent Application Laid-Open No. 8-310011 is unsynonymous to the fact that "the attached substances are actually removed by washing". That the attached substances remain has been clarified from the fact that there exists substances to be washed out or removed, when a fiber mass no longer undergoing a change in the ratio of the surface tension to the electric conductivity upon washing is washed out further upon dividing it into portions, which is proved by a measurement of weight change and an infrared spectroscopic spectrum analysis.

The second cause is that there are substances which cannot be removed with water and are dissolved out in an ink to adversely affect the suitability of the ink for inkjet. Namely, any treatment for removing the attached substances with water has its limit for meeting higher performance requirements even if various methods are adopted.

Further, a fibrous material itself is required not to release any component, which proves to be unfavorable to an ink itself and for the ejection of the ink from an ink-jet head, upon contact with the ink, or if any, to reduce its amount to an extent that such unfavorableness is not caused.

Japanese Patent Application Laid-Open No. 9-109410 discloses a forward contact angle necessary for a porous absorber used in the simplification and stabilization of filling of an ink into an ink-absorbing member, but neither describes nor suggests anything about an absorbing member obtained by molding fiber.

Besides, a further point to be considered includes a phenomenon described below.

Namely, there is a phenomenon that in a case where ejection energy is applied to an ink using an electrothermal converter, deposits may appear in a partial region within an ink ejection nozzle, which is distant from the electrothermal converter, not close to the electrothermal converter, in some cases, and wettability such as forward contact angle or backward contact angle with the ink in this region is different from surroundings, thereby causing deviation of an ejecting direction (slippage).

Fundamentally, the deposit is generally present in a trace amount (layer thickness of deposit: at most 1 im) and dissolved in inks, but may appear in some cases when a case where an ink-jet recording apparatus is left to stand in a dry environment or under conditions that the temperature is rapidly changed in a short period of time like in a heat cycle test is combined with a case where an ink droplet (at most 20 ng) having small kinetic energy is ejected. Namely, it has been found that components derived from various kinds of additives contained in a fibrous material as a product and treatment oils applied at a production stage are released into an ink upon contact with the ink, and a failure in ink ejection is caused by this.

In particular, a spinning oil and a finishing oil, which are applied as a lubricant, antistatic agent and the like to fiber during a production step of the fiber, contain an oily component and a surfactant in a mixed state, and moreover a neutralizer having a function to neutralize a residue in a polymerization catalyst, stabilizers or compatibilizers including an antioxidant, a lubricant, and the like are also added into a starting resin. When these substances are released into an ink, these move in the form of solutes having a low solubility or suspended matter together with the ink to form a deposit layer such as an oil film on an ejection opening face of an ink-jet head and remain there, thereby impairing the water repellency of the ejection opening face, which forms the cause that a failure in ink ejection is caused.

SUMMARY OF THE INVENTION

The present inventors have found that the above-described problems can be solved by using a specific treating agent to remove, or dissolve or emulsify such dissolving-out components in advance.

It is an object of the present invention to provide a fibrous material from which a member such as a not-expensive and high-performance ink-absorbing member, with which a liquid comes into contact, can be produced, and a production process thereof Another object of the present invention is to provide a member such as a not-expensive and high-performance ink-absorbing member, with which a liquid comes into contact, and a production process thereof.

A further object of the present invention is to provide a fibrous material in which the content of component (hereinafter may be referred to as "releasable component"), which is to be possibly released into an ink and forms the cause of a failure in ink ejection from an ink-jet head, is effectively held down, a member such as an ink-absorbing member, with which a liquid comes into contact, composed of the fibrous material, and production processes thereof.

A still further object of the present invention is to provide an ink-absorbing member which functions as a member for ink-jet and can be used in the production of an ink tank having a structure suitable for recycle, and a production process thereof.

Yet still a further object of the present invention is to provide an ink tank having a structure suitable for recycle, and an ink-jet apparatus using the ink tank.

The above objects can be achieved by the present invention described below.

In one aspect of the present invention, there is thus provided a process for producing a fibrous material for a member with which an ink-jet ink comes into contact, including the step of melt spinning a thermoplastic resin, the process comprising the step of: subjecting a spun yarn to a glycol treatment in which the spun yarn is contacted with a glycol added with ethylene oxide.

In another aspect of the present invention, there is also provided a fibrous material produced in accordance with the production process described above.

In a further aspect of the present invention, there is provided a fibrous material composed of a thermoplastic resin, to which a glycol added with ethylene oxide is applied.

In still a further aspect of the present invention, there is provided a fibrous material composed of a thermoplastic resin, wherein an amount released upon contact with an ink-jet ink of releasable components derived from treating oils, which are to be possibly released into the ink-jet ink, is at most 100 ppm based on the weight of the ink.

In yet another aspect of the present invention, there is provided an ink-absorbing member which can deliverably hold an ink-jet ink therein, wherein the member is composed principally of one of the fibrous materials described above.

In yet still a further aspect of the present invention, there is provided a process for treating an ink-absorbing member which can deliverably hold an ink-jet ink therein, the process comprising the steps of:

treating a molding comprising a fibrous material composed of a thermoplastic resin with a treating agent containing a glycol added with ethylene oxide.

In yet still a further aspect of the present invention, there is provided an ink-absorbing member treated in accordance with the treatment process described above.

In yet still a further aspect of the present invention, there is provided an ink-absorbing member which comprises a fibrous material composed of a thermoplastic resin and can deliverably hold an ink-jet ink therein, wherein an amount released upon contact with an inkjet ink of releasable components derived from treatment oils attached to the fibrous material, which are to be possibly released into the ink-jet ink, is at most 100 ppm based on the weight of the ink.

In yet still a further aspect of the present invention, there is provided an ink tank container for ink-jet head comprising an ink chamber having an opening part communicating with the air and an ink feed opening connected to the ink-jet head, wherein one of the ink-absorbing members described above is fitted within a region including the ink feed opening in the ink chamber.

In yet still a further aspect of the present invention, there is provided an ink tank container for ink-jet head comprising an ink chamber having an opening part communicating with the air, and a connecting chamber for head, which communicates with the ink chamber and is adapted to feed an ink from the ink chamber to an ink-jet head through a connecting opening to the ink-jet head, wherein one of the ink-absorbing members described above is fitted within the connecting chamber for head.

In yet still a further aspect of the present invention, there is provided an ink tank in which an ink-jet ink is charged into the ink chamber of the ink tank container described above.

In yet still a further aspect of the present invention, there is provided an ink-jet cartridge comprising the ink tank described above and an ink-jet head for ejecting an ink contained in the ink tank on a recording medium to conduct recording.

In yet still a further aspect of the present invention, there is provided an ink-jet apparatus comprising the ink-jet cartridge described above and a carriage on which the ink-jet cartridge is detachably mounted.

In yet still a further aspect of the present invention, there is provided a treating process for regenerating an ink-absorbing member for ink-jet composed principally of a fibrous material, the process comprising the step of:

treating the ink-absorbing member with a residual ink held therein with a treating agent containing a glycol added with ethylene oxide.

BRIEF DESCRIPTION OF THE DRAWINGS

FIGS. 10A and 10B are perspective views illustrating the structure of an ink-jet cartridge, in which FIG. 10A shows an ink tank, and FIG. 10B shows a holder portion integrally formed with an ink-jet head portion.

FIGS. 11A, 11B and 11C illustrate an example of the structure of an ink tank, in which FIG. 11A is a cross-sectional view thereof, and FIGS. 11B and 11C are partial cross-sectional views illustrating the steps of joining an opening part of the ink tank to a filter part on the side of a holder.

DETAILED DESCRIPTION OF THE PREFERRED EMBODIMENTS

The present invention will hereinafter be described taking ink-absorbing members as typical examples. However, the fibrous materials according to the present invention are not limited to materials for the ink-absorbing members, and can be suitably used as materials for forming members in devices for ink-jet and the like, with which an ink comes into contact, for example, members such as filters and cleaning members.

Forms of the ink-absorbing members according to the present invention include a member which is charged into and arranged in the whole ink chamber of an ink tank, and a joint member used at a joint to an ink-jet head.

The ink-absorbing members according to the present invention can be formed from a fibrous material produced using a thermoplastic resin such as, for example, a polyolefin resin or the like and are treated by bringing them into contact with a glycol added with ethylene oxide (hereinafter referred to as the "EO-added glycol") at any stage before contact with an ink upon their use. The treatment with the EO-added glycol can be conducted as at least one selected from among, for example, (1) a treatment for applying the EO-added glycol to a yarn;

(2) a treatment for replacing a releasable component to be possibly released into an ink in a yarn by the EO-added glycol to reduce an amount of the component; and (3) a treatment for dissolving or emulsifying the releasable component in a yarn in the EO-added glycol.

Examples of the EO-added glycol include acetylene glycol having a triple bond, in which it has at least one side chain at a central site of a linear main chain, and ethylene oxide is added to this side chain moiety, for example, those represented by a formula

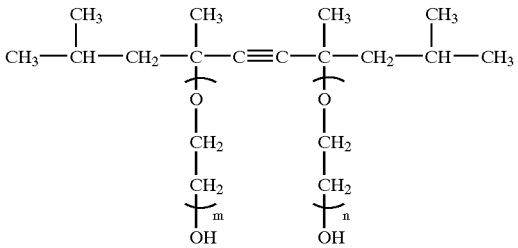

(I)

wherein m and n are individually an integer, in which the number (N=m+n) of moles of ethylene oxide (EO) added is 3 to 30. The properties of the EO-added glycol can be selected in any way so far as the effects of the present invention are achieved. However, EO-added glycols having an HLB of about 13 and a cloud point of at least 65EC are preferred. Those having a cloud point of at least 80EC are more preferred. Preferable examples of such preferred EO-added glycols include those in which the number of moles of EO added is 10 (e.g., ACETYLENOL E-H, trade name, product of Kawaken Fine Chemicals Co., Ltd.; and SURFYNOL 465, trade name, product of Air Products and Chemicals Inc.).

The EO-added glycols according to the present invention have been selected under the following circumstances.

Figure 1A:
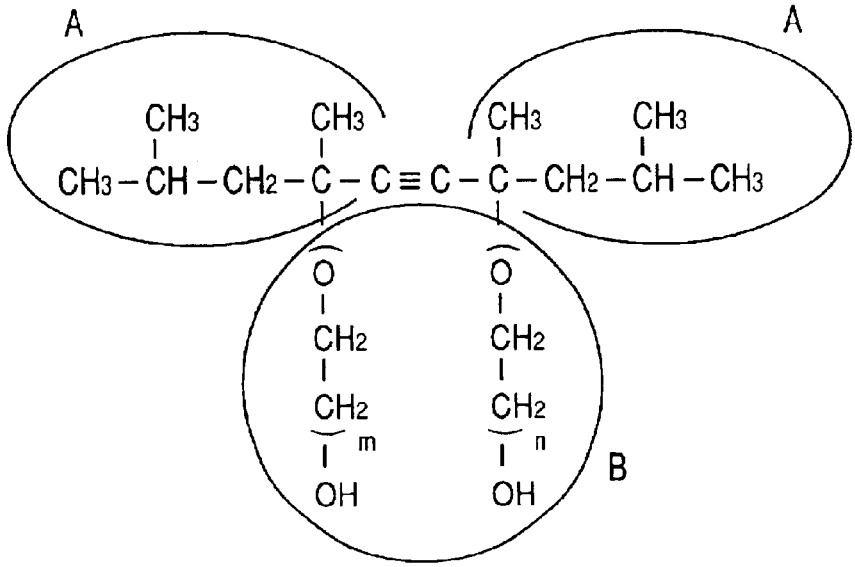
FIGS. 1A, 1B, 1C and 1D schematically illustrate molecular structures of surfactants.
Figure 1B:
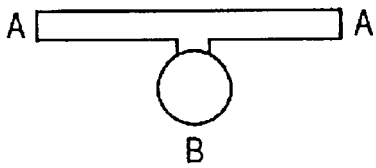
Figure 1C:
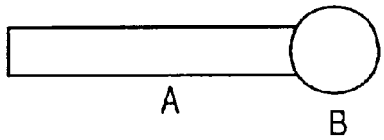
Figure 1D:
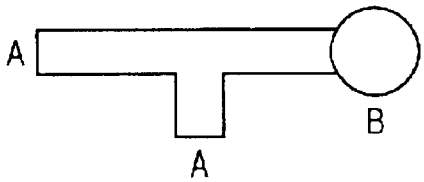

Viewed from the aspect of structure, surfactants include a monochain-hydrophobic group type, polychain-hydrophobic group type, cyclic hydrophobic group type, etc. Typical molecular structures thereof are illustrated in FIGS. 1B to 1D. FIG. 1C schematically illustrates the molecular structure (AB structure) of the monochain-hydrophobic group type, and FIGS. 1B and 1D illustrate the molecular structures (ABA structure and AAB structure, respectively) of the polychainhydrophobic group type. Incidentally, "A" and "B" denote a hydrophobic group moiety and a hydrophilic group moiety in FIG. 1A, respectively.

When a surfactant incorporated in an ink-jet ink, particularly, an ink used in a bubble jet system is selected, it is important to select it from the viewpoint of its influence on the storage stability of the resulting ink and on the degree of feathering of the ink on recording paper with respect to the physical properties of the ink and from the viewpoint of control of bubbles with respect to the stable feeding of the ink. In the bubble jet system in particular, it is important to select a surfactant from the bubble-forming ability and anti-bubbling ability of the surfactant.

The present inventors have first carried out an investigation as to various surfactants including a monochain type surfactant of the fatty acid ester type. As a result, surfactants, which universally exhibit an effect on inks having a pH within a range of from 6 to 11, have been found.

More specifically, general treatment oils are most suitably designed for imparting many functions such as antistatic property and bundling property to fiber (filament or yarn) and generally used as a combination of at least two components such as a surfactant and various additives. However, the treatment oils of the multi-component system are somewhat troublesome from the viewpoints of design of a composition and the like, complication of a production process, etc. Therefore, treatment oils of a one-component system are desirable if possible. For example, when attention is paid to the bundling property alone, it is possible to use water in place of the treatment oil. The present inventors have carried out various investigations on the basis of such points of view and succeeded in picking out the EO-added glycols, in particular, etherified compounds from a tertiary alcohol and polyethylene glycol, i.e., EO-added acetylene glycol. In the EO-added acetylene glycol, propylene groups respectively bonded to carbon atoms bonded to each other by a triple bond show hydrophobic nature, and the —CH2— groups of ethylene oxide (EO) added to the glycol moieties are well balanced with hydrophilic nature imparted by hydration of the ether bonds though they are hydrophobic groups (see FIG. 1A).

With respect to the cloud point of surfactants, it has been found that when a spinning oil is replaced in a hot-water stretching bath, a surfactant as a replacement agent is suspended in the hot-water stretching bath if the temperature of hot water is near to or higher than the cloud point of the surfactant to take the oil and releasable components, which have originally attached to fiber, in it, thereby lowering its effect to micellarly dissolve them. On the other hand, apart from a case where a suitable treatment oil is selected as the treatment oil attached in a step prior to the treatment with the EO-added glycol, a surfactant component derived from the treatment oil has a varied cloud point in an optional case and is hard to dissolve in a liquid of a temperature not lower than the cloud point of the surfactant. This is the reason why the surfactant as a replacement agent comes to be able to exhibit its function. The present inventors have found for the first time that the EO-added glycols have such an effect as the replacement agent, i.e., a replacement effect that components in a treatment oil (particularly, surfactant components in the treatment oil) and various additives contained in fiber are removed from the fiber to form micelle, and instead the glycol itself attaches to the fiber.

Some supplementary description is given on the cloud point characteristic of these nonionic surfactants. In ionic surfactants, their solubility gradually increases as the temperature is raised, and markedly increases at a temperature not lower than a Krafft point (Kp) because they disperse and dissolve in a micellar state. On the other hand, nonionic surfactants have a comparatively stable surface-active effect irrespective of pH and ionicity of an objective substance. Therefore, nonionic surfactants are used in the present invention. In the nonionic surfactants, however, their hydrating properties are lowered as the temperature is raised, and so they start undergoing phase separation for themselves at a temperature not lower than the cloud point (Cp) thereof to become cloudy.

ACETYLENOL E as a nonionic surfactant has a molecular structure illustrated in FIG. 1B and its HLB can be adjusted by the number of moles of EO added. Since it is stable to temperature and ultraviolet light and hence ensures stability in a production step of fiber or a hot molding step for molding a fibrous material into an ink-absorbing member and moreover has low foamability and high anti-foaming property, it is suitable for use in the treatments in the present invention. From another point of view, it involves no problem because of its excellent suitability for ink-jet in that even when the glycol is dissolved out in an ink after the fibrous material is formed into a member such as an ink-absorbing member, with which the ink comes into contact, the glycol itself can control the penetrability of the ink applied to the surface of recording paper in a thickness direction of the recording paper while suppressing diffused penetration of the ink in a plane direction of the recording paper and that it can enhance bubble-jet stability in an ink-jet system that ejection energy is applied to an ink by an electrothermal converter.

In addition, in order to impart dissolution stability to a coloring material, for example, a dye, in an ink, it is generally conducted to control the pH of the ink within a range of from weak acidity to alkalinity. Taking this point into account, it is desirable to use a treating solution having a pH close to the pH of the ink as much as possible. Therefore, when a solution of an EO-added glycol in a 0.001 to 0.1 N aqueous solution of sodium hydroxide as a solvent is prepared, better results are brought about. The ACETYLENOL E described above is stable even under a strong alkali and also preferred from this point of view.

The treatment with the EO-added glycol will hereinafter be described in due order from the production step of a fibrous material.

Figure 2B:
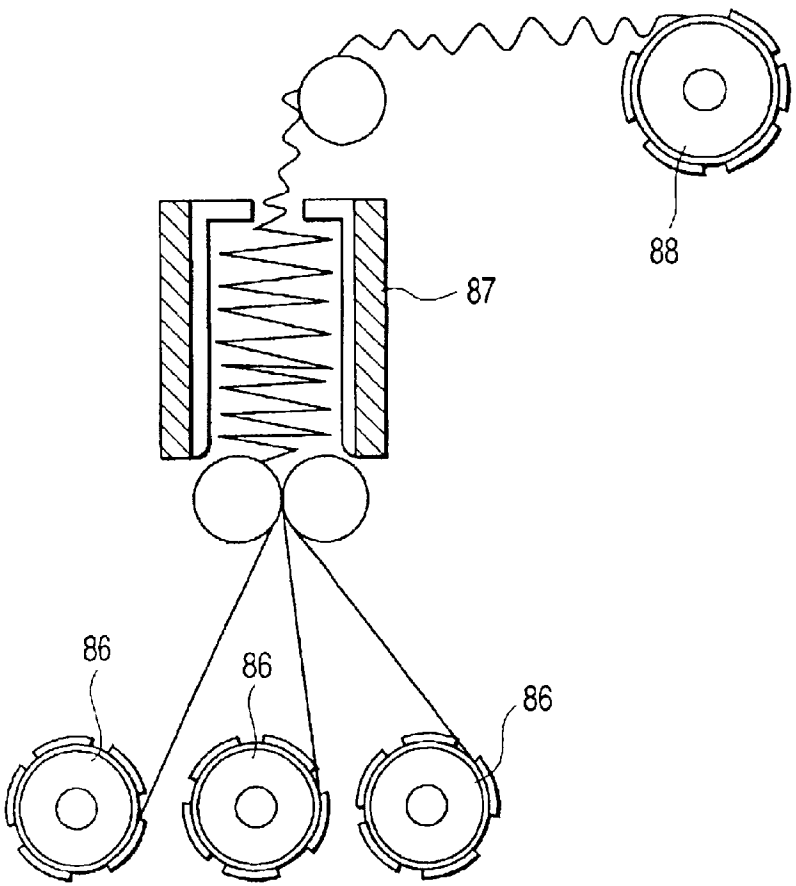
FIGS. 2A and 2B illustrate a spinning step.
Figure 2A:
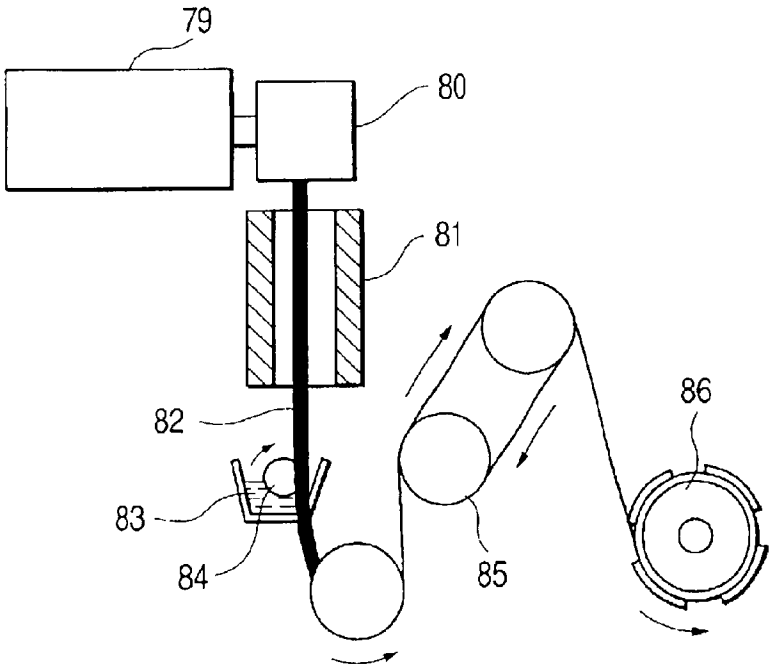

FIGS. 2A, 2B, 3, 4 and 5 illustrate an example of a spinning step of a fibrous material using a thermoplastic resin. FIGS. 2A and 2B relate to a spinning step for filament, and FIGS. 3 to 5 relate to a spinning step for staple.

As illustrated in FIG. 2A, a thermoplastic resin in a polymer melter 79 is extruded in a molten state from an extruder 80 and then cooled in an air-cooling tube 81 to form a yarn or thread. A spinning oil 83 is applied to the surface of the cooled yarn by a roller 84, stretched by a roller 85 and then wound on a bobbin 86. As illustrated in FIG. 2B, further, yarns from a plurality of such bobbins 86 are subjected to a crimper 87 and the thus-obtained crimped yarn is wound on a take-up coil 88.

Figure 3:
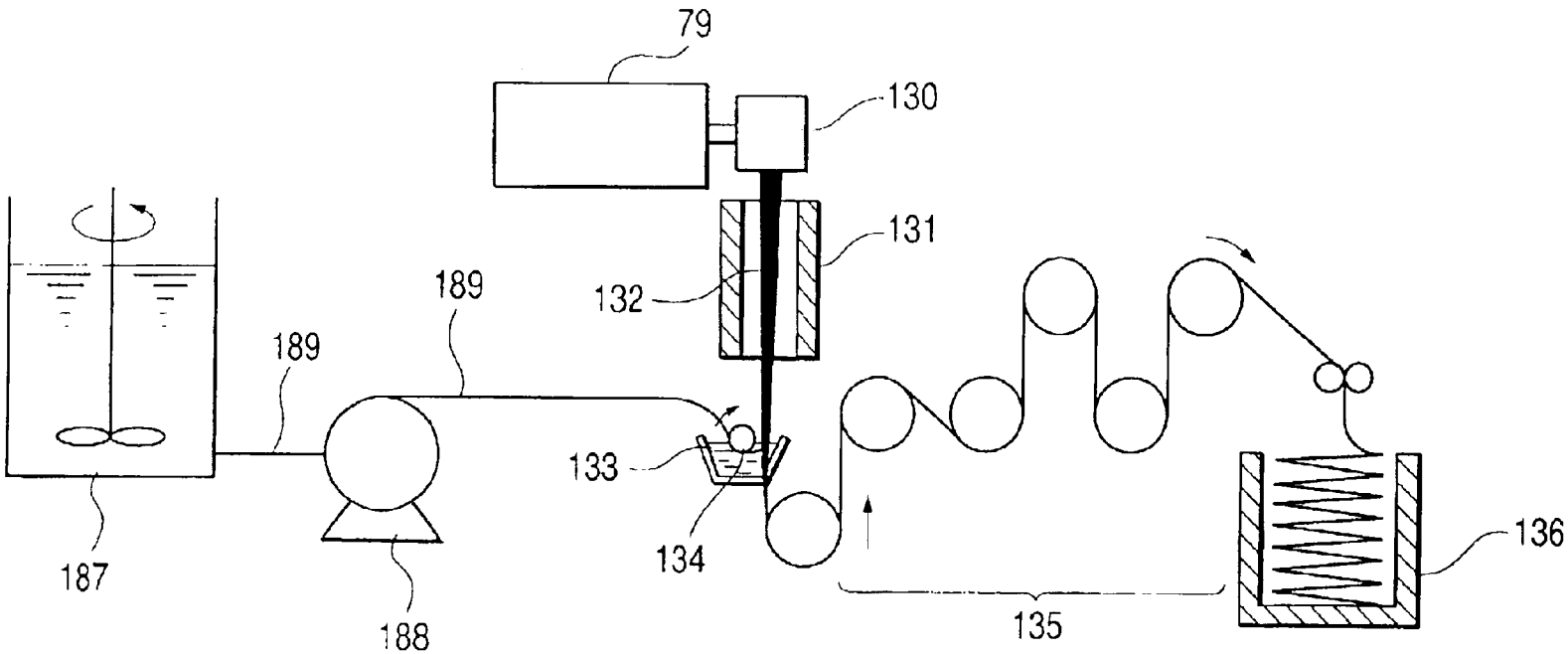
FIG. 3 illustrates another spinning step.
Figure 4:
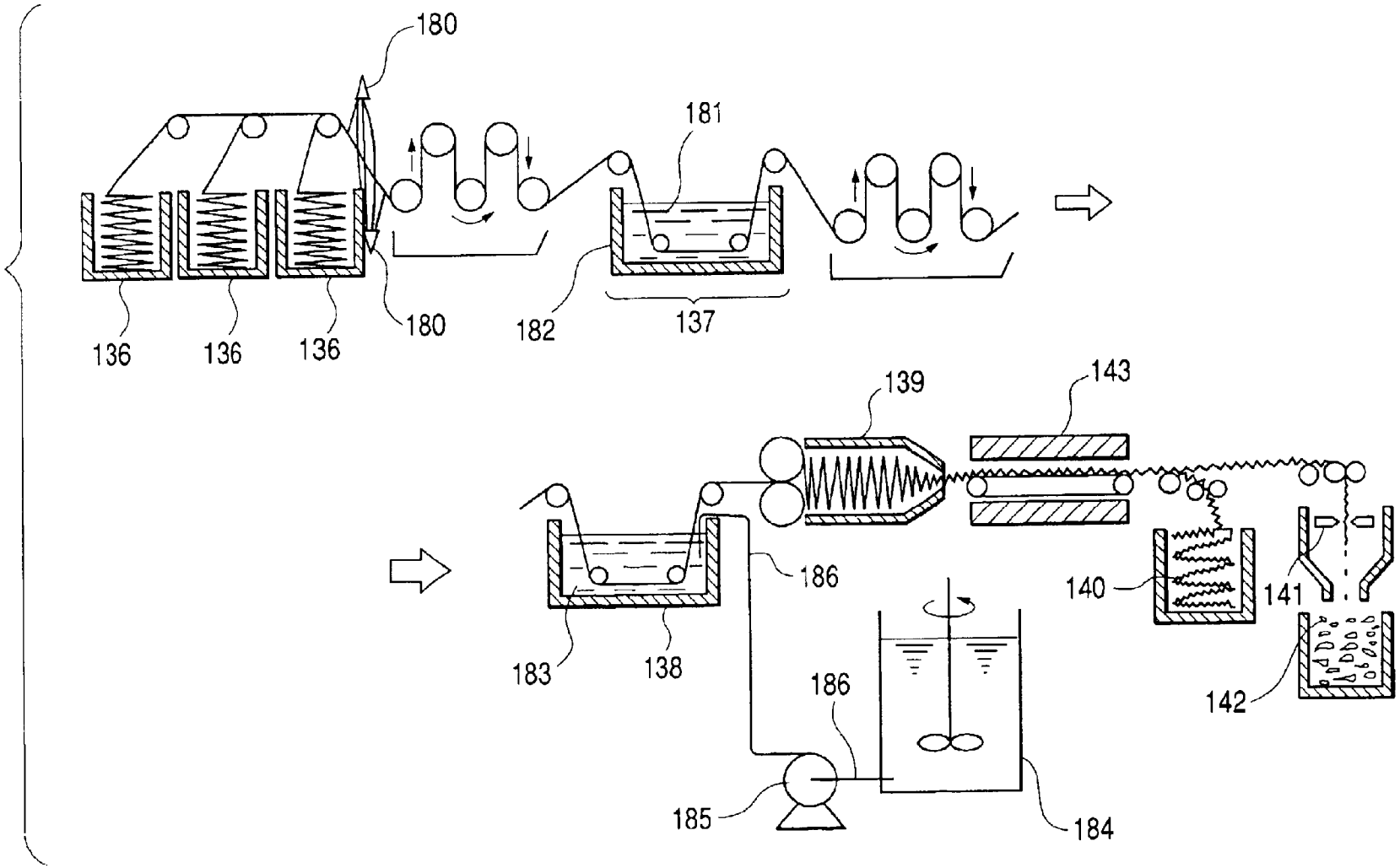
FIG. 4 illustrates the steps of stretching and finishing a spun yarn in the step illustrated in FIG. 3.
Figure 5:
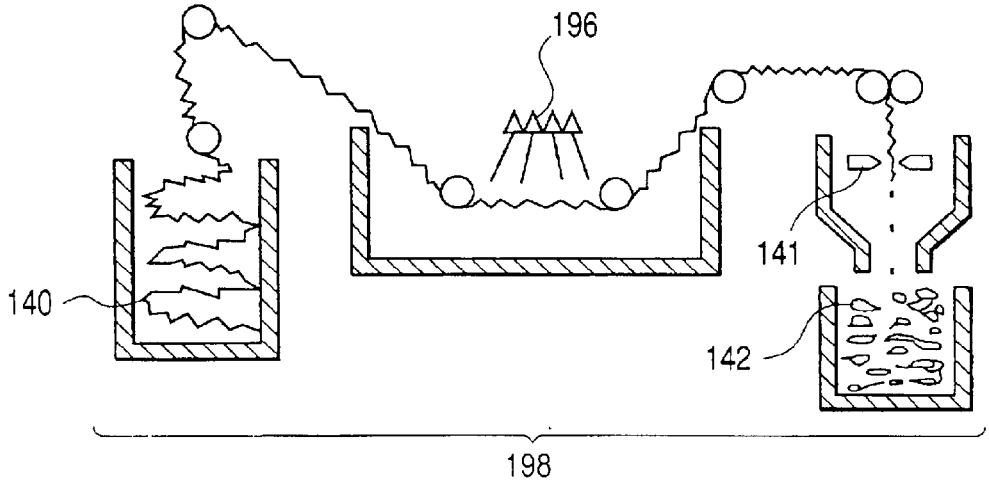
FIG. 5 illustrates the step of treating yarn obtained through the steps illustrated in FIG. 4 by spraying a treating agent containing a glycol added with EO (ethylene oxide).

FIGS. 3 to 5 will be explained. First, as shown in FIG. 3, a thermoplastic resin in a polymer melter 79 is extruded in a molten state from an extruder 130 and then cooled in an air-cooling tube 131 to form a yarn or thread. A spinning oil 133 is applied to the surface of the cooled yarn by a roller 134, roughly stretched by rollers 135 and then received in a can 136. The spinning oil 133 is prepared in an oil formulating tank 187 and fed through a liquid-feed pipe 189 by a pump 188. Thereafter, as illustrated in FIG. 4, yarns are collectively taken out of a plurality of the cans 136 and heated with hot water 181 in a stretching bath 182 to be stretched at a stretching step 137. Further, a finishing oil 183 is applied to the yarns and the yarns are then crimped by a crimper 139. Thereafter, the thus-obtained crimped yarn is passed through a drying oven 143 and stored as a tow 140 or as staple fiber 142 obtained by chopping the tow by a cutter blade 141 according to the form of use. The finishing oil 183 is prepared in an oil formulating tank 184 and fed to an oil treatment bath 138 through a liquid-feed pipe 186 by a pump 185.

In the present invention, as the thermoplastic resin, for example, a polyolefin resin or a polyester resin is used taking account of production cost, performance, easiness of recycle, etc. Since the polyolefin resin is chemically stable and resistant to acids, alkalis and various solvents, and has an excellent water vapor barrier property, it is also used in members such as an ink-jet head and an ink tank, with which an ink comes into contact. The polyolefin resin is preferred in that availability by recycle is enhanced by using the same material as that used in the ink tank. The polyolefin resin may be a blend of a plurality of resins so far as they have high crystallinity and are compatible with each other. Specific examples of the polyolefin resin include polymethylpentene (specific gravity: 0.83) of the lightest weight as well as polypropylene (specific gravity: 0.91) coming second in specific gravity, polyethylene, ethylene-propylene copolymers and ethylene-á-olefin copolymers. At least one selected from among these resins may be used. When materials giving care to environment and fitting in a resources-recycling-type society will be designed, it is desirable to use polypropylene, which is a cheap, general-purpose resin, since it is utilized in various fields ranging from daily needs to heat-resistant cooking containers for food, storage containers, medical syringes, transfusion bags and filters for water treatment in a semiconductor field.

The investigation by the present inventors has revealed that when a fibrous material using a polyolefin resin is used to form a member for ink-jet, with which an ink comes into contact, it is important to further investigate dimensional, structural and chemical characteristics of fiber. With respect to polypropylene having tertiary carbon atoms every other atom in a polypropylene skeleton, LDPE (low-density polyethylene) having many side chains, or the like, attention has been paid to additives such as antioxidants which bear chemical stability, and neutralizers.

A supplementary description will hereinafter be given on additives for, in particular, polyolefin resins by way of representatives. The antioxidants are classified roughly to primary antioxidants and secondary antioxidants. The former antioxidants include phenolic antioxidants and amine type antioxidants which function as radical chain terminators. The latter secondary antioxidants include sulfur type anfitioxidants and phosphorus type antioxidants which function as decomposers for peroxides formed. When described in detail, what is used for preventing decomposition and deterioration by radicals generated in a resin by an external cause such as oxygen, heat or ultraviolet light from growing like a chain reaction is the primary antioxidant, or the radical scavenger in terms of action, or the radical chain terminator in terms of purpose. What is used for decomposing peroxides formed while inhibiting generation of radicals is the secondary antioxidant, or the peroxide decomposer in terms of action. Specifically, typical phenolic antioxidants include BHT (2,6-di-t-butyl-p-cresol) and the like. However, tetrakis-[methylene-3-(3',5'-di-t-butyl-4'-hydroxyphenyl) propionate]methane having a high melting point is desirable. On the other hand, the sulfur type antioxidants include distearyl thiodipropionate (DSTP) and the like. In both antioxidants, those having a high melting point are desirable from the point that they are hard to be released into an ink upon contact with the ink.

On the other hand, it is possible to select a good additive even from among hindered amine type antioxidants and the like. However, such an additive is easy to be released into an ink. Therefore, it is desirable to select it on the premise that it is easy to be released. The object of the present invention is to ensure the good suitability of a fibrous material for ink-jet while producing the fibrous material in a widely-used manner as much as possible to reduce its production cost. From this point of view, it is not desirable to limit even additives contained in a starting resin. It is hence preferred to strictly select a starting resin grade, in which preferred additives are used, from among the already existing general-purpose grades of general-purposed resins.

On the other hand, in order to obtain a compatibilizing function for uniformly dispersing these antioxidants in a resin, or a lubricating function and a neutralizing function to a polymerization reaction catalyst, calcium stearate or the like is generally used. When calcium stearate is used, greater care than in the antioxidants is necessary in the replacing treatment.

With respect to calcium stearate and the like, it is also considered as a choice to replace them by a pure organic neutralizer free of any inorganic component. However, it is desirable to maintain the point of view that no change in general-purpose materials is made.

As described above, the additives incorporated in the starting resin may be separated from the fiber upon contact with an ink-jet ink and released into the ink in some cases. When the amount of the additives released is large, ink ejection by an inkjet head may be adversely affected. In particular, when the fiber is subjected to a heat treatment in the form of heat-adhesive fiber to conduct partial bonding among fibers, these additives become easy to separate.

As a method for solving such a problem, there is a method in which those hard to be released into an ink are chosen for use as additives. However, this method comes to lower the general-purpose property of the starting resin. Therefore, the treatment with the EO-added glycol is conducted in the present invention, whereby an adverse influence on the ink can be effectively suppressed even when any general-purpose additive having a possibility that such a problem as described above may be caused is used.

When attention is then paid to materials used in the production step of the fibrous material, the spinning oil for fiber functions as a lubricant and/or an antistatic agent and is applied for the purpose of smoothly conducting a spinning process, and the composition thereof is selected according to starting materials used. It usually contains an oily component such as a higher alcohol and a surfactant as main components. The finishing oil also functions as a lubricant and/or an antistatic agent and moreover is used for imparting necessary properties to the resulting product. This oil also usually contains an oily component such as a higher alcohol and a surfactant as main components.

When an ink-absorbing member is formed with a fibrous material in a state that these treatment oil components have been held and used in an ink tank, the treatment oil components are released from the fibrous material making up the ink-absorbing member. If the amount of the components released is large, it may form a cause that a failure in ink ejection from an ink-jet head occurs, in some cases.

As described above, as main factors that are contained in the fibrous material and adversely affect the suitability for ink-jet, may be mentioned the additives contained in the starting resin and treatment oils applied at its production stage. In the present invention, the fiber is treated with the EO-added glycol at a proper stage in the production process of the fibrous material, whereby the influence of these factors on the suitability for ink-jet can be eliminated. The stage at which this treatment is conducted may be suitably selected from among stages at which the objects of the present invention can be achieved and the production of the desired fibrous material is not prevented. Examples of preferred stages and treatment steps thereat include:

a) a step of applying the EO-added glycol to a spun yarn by contacting the yarn with the EO-added glycol contained in a spinning oil at the time of melt spinning;

b) a step of contacting an unstretched yarn treated by a spinning oil after melt spinning with a treating agent containing the EO-added glycol;

c) a step of contacting an unstretched yarn with a treating agent containing the EO-added glycol during a step of stretching the unstretched yarn which has been melt spun;

d) a step of contacting a stretched yarn with the EO-added glycol contained in a finishing oil; and e) a step of contacting a yarn obtained after the stretching with a treating agent containing the EO-added glycol.

Incidentally, at least two of these steps may be used in combination. Further, the treatment with the EO-added glycol may be combined with the supply of a lubricant for a cutter blade used in cutting a fibrous material or a lubricant for a sliding part of a mold used in hot-molding a fibrous material.

In a case of using a treatment oil added with the EO-added glycol, the EO-added glycol of at least 80% by weight of the treatment oil may be used. The change of the component in the treatment oil to the EO-added glycol as described above permits imparting good suitability for ink-jet to the resulting yarn mainly due to the surface-active function of the EO-added glycol while controlling lowering of the functions inherent in the treatment oil to the minimum.

When the unstretched yarn after the melt spinning is treated with the EO-added glycol, a spray treatment or dip treatment with an aqueous solution (for example, at a concentration of from 0.1 to 5% by weight) containing the EO-added glycol may be used. The spinning oil attached to the yarn and the additives contained in the resin forming the yarn can be effectively dissolved or emulsified by this treatment, thereby removing them from the yarn. In addition, since the components derived from the treatment oil are solubilized or emulsified by the treatment with the EO-added glycol to an extent that no influence is exerted on ink ejection even if they are released into an ink, no problem arises even if they remain attached to the yarn. The EO-added glycol has functions as an antistatic agent and a lubricant in the same degree as those of a nonionic treatment oil. Therefore, even if most of the spinning oil is replaced here, easy operation in the subsequent steps is not impaired, because the EO-added glycol is applied to the yarn in place of the spinning oil, so far as the amount of the EO-added glycol applied is made appropriate. An example where the spray treatment is conducted is shown in FIG. 4. In the example shown in FIG. 4, a treating agent containing the EO-added glycol is sprayed on the yarns by a sprayer 180 before the yarns are collectively passed through rollers from a plurality of cans 136.

The amount of the EO-added glycol applied to the yarns in this treatment amounts to, for example, 5% by weight in a wet state. When a 2% aqueous solution is used as the treating agent, therefore, the amount applied accounts for 0.1% by weight. An anionic potassium salt was determined as residue of the treatment oil. As a result, it was identified as 0.01% by weight or lower (100 ppm or lower).

The EO-added glycol shows a great solubilization power against all of cationic, anionic, amphoteric and nonionic treatment oils. Therefore, influence of the treatment oil carried to the subsequent steps can be suppressed by this treatment. Further, even when a component of the treatment oil shows either strong lipophilic nature (hydrophobic nature) or strong hydrophilic nature, the replacing effect can be achieved by selecting the kind of the EO-added glycol used. The selection of the composition of the treatment solution used between the spinning and the stretching, alteration of arrangements, and the like are very simple compared with alteration of arrangements in a step of applying the treatment oil on the premise that it is applied to the surface of fiber, and so the improvement of operating efficiency in the production line of the fibrous material is brought about.

In productive facilities in which a system that stretching is conducted in hot water is adopted, or in productive facilities in which a system that preheating for stretching is conducted in hot water is adopted, this treatment may also be conducted by combining this stretching bath or preheating bath with a dipping bath for the treatment with the treating agent containing the EO-added glycol to carrying out the treatment with the treating agent. In the steps illustrated in FIG. 4, the EO-added glycol may be added into hot water 181 for stretching to conduct the treatment with this EO-added glycol. The amount of the EO-added glycol added into the hot water may be adjusted within a range of, for example, from 2 to 5% by weight. Incidentally, since the substances which have been replaced are dissolved out in this hot water 181, it is desirable to check the concentration of the replaced substances together with the concentration of the EO-added glycol while observing the specific gravity, surface tension, pH and the like of the hot water.

Further, the treatment with the EO-added glycol can be conducted by allowing the EO-added glycol to be contained in a finishing oil. The content of the EO-added glycol in the finishing oil may amount to 80% by weight or higher.

By replacing components in the treatment oil, particularly, surfactant components by the EO-added glycol as described above, substances showing good suitability for inkjet can be applied to the yarn, without disturbing the production of fibrous material.

Incidentally, when only the replacing treatment by the change of the spinning oil to the EO-added glycol or the application of the EO-added glycol to the unstretched yarn is conducted, and the addition of the EO-added glycol to the finishing oil is not conducted, it is desirable to choose for use a nonionic surfactant, which is capable of imparting destaticizing and lubricating functions, as the finishing oil. Specific examples thereof include polyoxyethylene sorbitan fatty acid esters and polyethylene glycol fatty acid carboxylates.

Even the yarn subjected to the treatment with the finishing oil after stretching may be treated with the EO-added glycol at a proper stage. This treatment can be conducted with an aqueous solution (concentration: 0.05 to 2% by weight) of the EO-added glycol. In this treatment, may be used a spray treatment, dip treatment and the like in a case where a continuous yarn material is treated, or a dip treatment under optional stirring in a case where a fibrous material cut into proper lengths is treated. FIG. 5 illustrates an example of the treating step 198 for spraying tow 140 with a treating agent containing the EO-added glycol by a sprayer 196. Incidentally, reference numerals 141 and 142 denote a cutter blade for chopping the tow 140 and staple fiber obtained by chopping, respectively. The degree of retention of components derived from the treatment oil in this treatment is preferably preset in such a manner that the amount of such components to be released into an ink-jet ink upon contact with the ink is preferably at most 100 ppm, more preferably at most 20 ppm, based on the weight of the ink.

The determination of the released amount of the releasable components can be simply and efficiently performed by selecting components, from which the dissolved-out amount of the subject dissolving-out components can be grasped by quantitatively suppressing such components, from among components which are contained in various additives contained in a starting resin, and treatment oils used at a production stage and cause a disadvantage when released into an ink, and determining the volume thereof. For example, when a polyolefin resin, particularly, polypropylene is used as a starting resin in the form of felt, a treatment oil comprising an anionic surfactant as a main component is generally often used for attaching much importance to a destaticizing function during the production process. As the main component in such a treatment oil, there is used at least 70% by weight of a mixture of potassium stearate phosphate (destaticizing function), an alkyl phosphate (destaticizing effect), polyethylene glycol (emulsifying effect), dimethylsilicone (anti-foaming function) and the like. Therefore, quantitative analysis is conducted by means of an ICP analysis (plasma emission spectrometer) using Si (silicon), P (phosphorus) and K (potassium) as indices, whereby the amount of the dissolved-out components can be determined from the amounts of these trace elements.

Figure 6A:
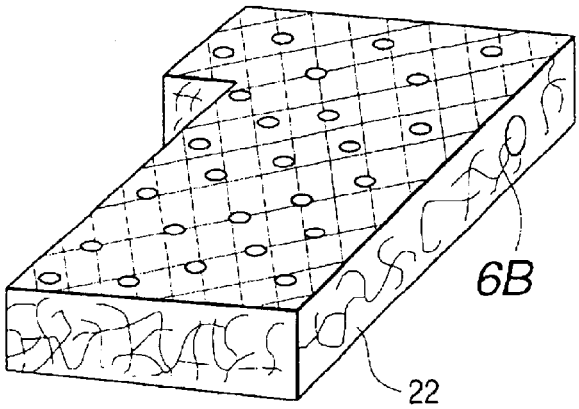
FIGS. 6A and 6B illustrate the structure of an ink-absorbing member using a heat-adhesive fiber.
Figure 6B:
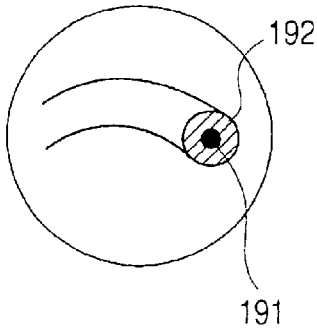

FIG. 6A illustrates an ink-absorbing member 22, and FIG. 6B is an enlarged drawing of a yarn which constitutes the ink-absorbing member 22 of FIG. 6A.

When a fibrous material of core and shell structure using polyester (PET) fiber as a core 191 and a heat-adhesive component of polyethylene (PE) as a shell 192 as illustrated in, for example, FIG. 6B is produced using an ordinary spinning oil and finishing oil and then subjected to a replacing treatment with the EO-added glycol, the treatment oil components can be effectively removed. Besides, even if some components derived from the treatment oils remain on the fibrous material without removal, such components may remain on and attach to the fiber together with the EO-added glycol in a dissolved or emulsified state in which no or little problem arises even when they are released into an ink. In this case, it is only necessary to add a simple step of treating with the EO-added glycol without altering the production process of the fibrous material. Therefore, the fibrous material can be mass produced at a low cost.

When a heat-treating step at a high temperature, a treating step with ultraviolet light or a treating step with ozone is provided in the production process of the fibrous material, the replacing treatment with the EO-added glycol may be conducted after these treatments and at a stage at which the objects of the present invention can be achieved.

As described above, the method in which the replacing treatment with the EO-added glycol is conducted as the final stage of the production process of the fibrous material is preferred in that the effects of the present invention can be achieved by making simple alteration on production line that the replacing treatment is added at the final stage without making great alteration on the production line. For example, in a case that alteration on the production line is necessary for the purpose of enlarging the scale when transferring from a stage of trial manufacture and investigation to a stage of trial manufacture for preparation for mass production, and as a result, groups of fiber (different in both starting resin and treatment oil) produced while altering arrangements vary, and changes in additives contained in the starting resin and components of the treatment oil affect the suitability for ink-jet, namely, in a case that a problem arises on printing performance according to the starting resin and treatment oil used, deviation in properties due to such changes in the starting resin and treatment oil by the alteration of arrangements during continuous running of the line can be eliminated by setting the treatment with the EO-added glycol at the final stage.

This problem as to the occurrence of a problem due to the alteration of arrangements suggests that there is need for not only specifying the compositions of the starting resin and treatment oil related to the problem, and process water (from which reactive metal ions, organic substances and bacteria or fungi are desirably removed; specifically, ion-exchanged water or purified water is preferred), but also specifically specifying substances attached to fiber to investigate their relation to the problem. However, it is extremely difficult from the viewpoint of practical use to request so in the production line of various kinds and mass production. Therefore, simple alteration on the line that the replacing treatment with the EO-added glycol is added without making great alteration on the production process itself of the fibrous material is an extremely practical and useful means in that a fibrous material or a molding using the fibrous material, which maintains its quality at low cost and can achieve the effects of the present invention, can be provided.

A member such as an ink-absorbing member used for an ink-jet ink, which is used at a site where it comes contact with the ink, can be formed with the thus-obtained fibrous material. The form of the ink-absorbing member may vary. For example, it may be used in the form of a bundle, compressed bundle, web, nonwoven fabric, felt, or woven fabric of a varied form. The length, diameter, various physical properties and fiber density of the fibrous material may be suitably selected according to the desired properties of the ink-absorbing member. Further, at least two fibrous materials may be used in combination, or heat-adhesive fiber may be used to partially bond fibers to each other so as to take a structure ensuring spaces 152 among the fibers 151 as illustrated in FIG. 7B. The ink-absorbing member 154 may be such that it has neither the predetermined ink absorbency nor ink-releasing property in a state prior to filling into an ink tank container, but comes to have the predetermined fiber density (interfiber distance) in a state compressed and filled into the ink tank container to exhibit its functions.

Figure 7A:
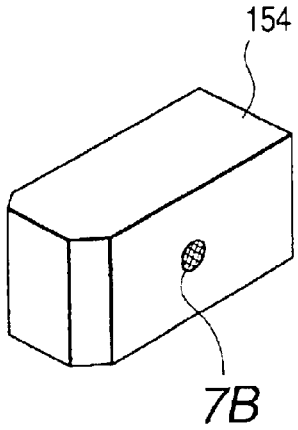
FIGS. 7A, 7B and 7C illustrate the structure of an ink-absorbing member using another heat-adhesive fiber.
Figure 7B:
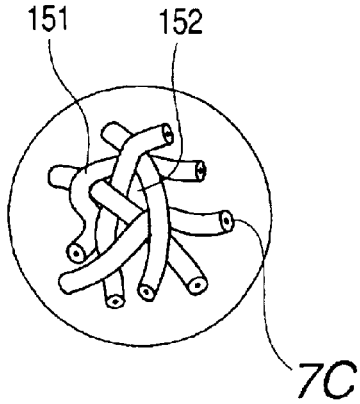
Figure 7C:
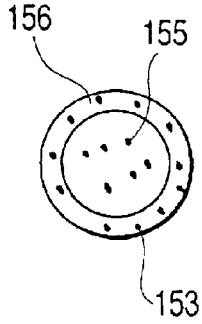

FIG. 7B is an enlarged drawing of a portion of an ink-absorbing member 154 in FIG. 7A, and FIG. 7C is an enlarged drawing of a cross section of fiber 151 in FIG. 7B. Reference numerals 155 and 156 denote a core and a shell, respectively, and reference numeral 153 is an additive in the shell 156.

The examples where fibrous members, with which a liquid comes into contact, are formed using the fibrous materials produced by the processes comprising a melt spinning step and a stretching step irrespective of the form of fiber, such as filament or staple, have been described above. However, the same effects can be obtained by conducting the treatment of a fibrous material with the EO-added glycol at a proper stage in a melt blow process in which a stream of ultrafine staples created by directly blowing a melt spun fiber is collected and the fibers are bonded to one another to produce a nonwoven fabric, or also in a spun bond process in which a stream of filaments is similarly collected and the fibers are bonded to one another to produce a nonwoven fabric, in a state of the nonwoven fabric. In these methods, a resin is used as a functional material without stretching and orientating it. Therefore, various additives may be exposed or separated from intermolecules on the surface of the fiber in some cases, and so the treatment with the EO-added glycol according to the present invention is useful.

On the other hand, the treatment with the EO-added glycol according to the present invention may also be conducted at a proper stage from the formation of the ink-absorbing member to its installation in an ink tank to actually fill the ink-absorbing member with an ink.

When the ink-absorbing member itself is treated, for example, a method in which the ink-absorbing member is dipped in a treating agent containing the EO-added glycol under optional stirring may be used. In this case, the concentration of the EO-added glycol may be controlled to, for example, about 0.5 to 2% by weight. Incidentally, when an alcoholic solvent, for example, isopropyl alcohol and the like, is used as this treating agent, all the components of treatment oils are not dissolved in this agent, and moreover the effect of making oil components remaining on the surface of fiber a solubilized or emulsified state in which no problem arises upon their dissolving-out into an ink cannot be even achieved. Namely, according to the treatment with the EO-added glycol, the oil components are formed into macromolecule to become a solubilizable or emulsifiable state, and released into the treating agent. Even if some of them remain attached to fiber together with the treating agent, they can have solubility or emulsifiability in a degree that no problem arises upon their dissolving-out into an ink. In addition, when the EO-added glycol is used, even components of additives incorporated into a starting resin for a fibrous material, which may be dissolved out upon contact with an ink, can also be solubilized or emulsified to be removed into the treating agent. According to this treatment, the oil components and additive components contained in the fibrous material are consequently replaced by the treating agent containing the EO-added glycol to be removed from the fiber, and no problem arises even if some of them remain attached to the fiber.

It has been confirmed that when for example, the heat-adhesive fibrous material illustrated in FIG. 7B is used and subjected to a heat treatment, whereby bonded parts are partially formed among fibers 151 to ensure spaces 152 among the fibers as illustrated in FIGS. 7A to 7C, thereby forming an ink-absorbing member 154, or when as illustrated in FIGS. 8A to 8D, staple fiber 201 composed of polypropylene (PP) and staple fiber 203 composed of polyethylene (PE) are blended, and thermally fusion-bonded parts are partially formed therebetween by a heat treatment, thereby forming an ink-absorbing member 206, the amount of releasable components, which cause an disadvantage upon ink ejection by an ink-jet head, increases. According to an investigation regarding this by the present inventors, the following has been confirmed. Although additives contained in starting resins, particularly, antioxidants and neutralizers in polyolefins for stabilizing tertiary carbon in a propylene skeleton, or side chains in polyethylene, which are always formed in view of polymerization, are essential, these additives become easy to be dissolved out and separated, since when the fibers crystallized and oriented in a stretching step are softened and melted again by a heat bonding treatment upon the production of an ink-absorbing member, the fibers once return to an amorphous state, and some of the additives transfer to intersections among the fibers, and when the fibers are recrystallized with cooling, the additives are forced to grain boundaries therebetween, and moreover the degree of crystallinity is also not enhanced, even after solidified. In particular, it has been found that the possibility becomes higher in additives having a low melting point. More specifically, with respect to materials for ink tanks, for example, injection molding materials and blow molding materials, it has heretofore been conducted to select and improve materials in view of their suitability for inks. With respect to fibrous materials, however, it has been found that the mere conventional findings are insufficient, and a special problem arises when the heat-adhesive fibrous materials are used.

Figure 8A:
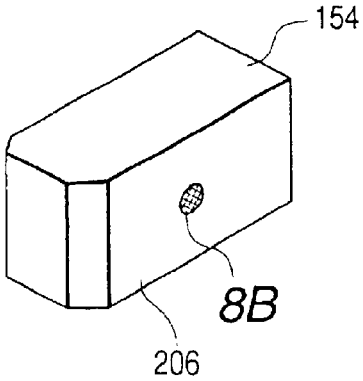
FIGS. 8A, 8B, 8C and 8D illustrate the structure of an ink-absorbing member obtained by blending two kinds of fibers and fixing a network structure by thermal adhesion.
Figure 8B:
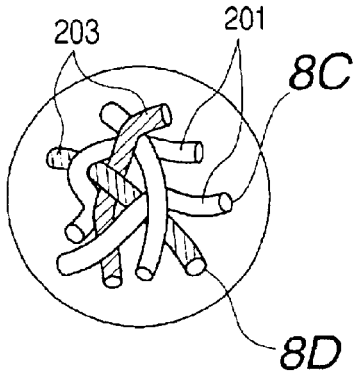
Figure 8C:
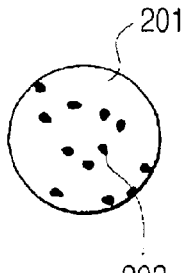
Figure 8D:
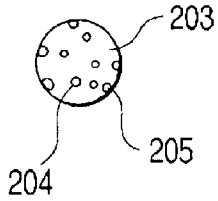

FIG. 8B is an enlarged drawing of a portion of an ink-absorbing member 206 in FIG. 8A, FIG. 8C is an enlarged drawing of a cross section of a polypropylene fiber 201 in FIG. 8B and FIG. 8D is an enlarged drawing of a cross section of a polyethylene fiber 203 in FIG. 8B. Reference numeral 202 denotes an additive in the polyethylene fiber 201 and reference numeral 204 denotes an additive in the polyester fiber 203 and reference numeral 205 is an additive present at,a surface of the polyethylene fiber 203.

The fact that such additives become a state easy to be released into an ink is considered to greatly depend on the form of fiber. A ratio of the surface area of fiber to the volume thereof is considerably high (different by about two or three figures) unlike films and sheets. First, it is necessary to take care of this regard. It has also been confirmed that their diameter is also thin (about 10 to 50 im in diameter) and so the additives are relatively easy to be exposed, and that the additives become easy to be separated due to the influence of a heat treatment, specifically, the action of heat itself, or a combined use of the heat-adhesive fiber in addition to a secondary action thereof, or the fact that, in the case of a form coated with a heat-adhesive component, some of the additives are transferred to intersections among the fibers, when the heat-adhesive resin is once softened and melted, and the additives are forced to grain boundaries therebetween, when the resin is recrystallized with cooling.

When the replacement of such oil components attached to the staple fibers (including the replacement of thermally denatured substances of the treatment oil, in a case where the heat resistance thereof is insufficient) and moreover the replacement of the additives which are separated upon the heat treatment and become a state easy to be released (in some cases, including thermally denatured substances of the additives) are conducted with a treating agent containing the EO-added glycol, a problem that ink ejection is affected by releasable components derived therefrom can be prevented. In addition, when the EO-added glycol is used, hydrophobic additives may also be replaced due to its dissolving or emulsifying effect, and particularly the deposition of the hydrophobic additives on an ink-ejection opening face subjected to a water-repellent treatment can be prevented.

Therefore, the influence of these additives on ink ejection can be eliminated.

Incidentally, the ink-absorbing member is formed into an ink tank by housing it in an ink tank container and feeding an ink thereinto. After conducting the replacing treatment with the treating agent containing the EO-added glycol, it is preferred to rinse the ink-absorbing member with a similar solution to the treating agent, thereby letting a slight amount of the EO-added glycol remain attached to the fiber forming the ink-absorbing member, in that the ink can be more stably and uniformly fed.

As described above, the treatment with the EO-added glycol in the present invention is preferably conducted by the method in which the treating step with the treating agent containing the EO-added glycol is added without altering the production process having high general-purpose property. As reasons for it, may be mentioned the following three points.

First, the changes of the treatment oils in a maker, in which various kinds of fibers are mass-produced, bring about marked lowering of productivity due to stopping a production line at the time of arrangements, as clear when supposing alteration of arrangements of, for example, the oil compounding tanks 184, 187, the liquid-feed pipes 186, 189, the oil treatment bath 138 and the like as illustrated in FIGS. 3 and 4 in view of the production scale. As a result, the fibrous materials obtained become expensive. On the other hand, in devices for the replacing treatment, which have been process-designed for exclusive use in ink-jet in view of productivity, for example, the devices respectively using sprayers 180, 196 as illustrated in FIGS. 4 and 5, it follows that a step is added. However, such devices can rather bring about reduction in cost and good maintenance in quality.

Second, a felting step in a case where felting is conducted requires a treatment for bringing about a destaticizing effect for the purpose of achieving stable passability through a carding machine or the like though it varies a little according to its process setting. Auxiliary means such as a destaticizer and humidifier are also effective for such a treatment. However, the EO-added glycol has a function of imparting a destaticizing effect as well. Therefore, the replacing treatment with this compound permits not only obtaining good suitability for ink-jet, but also imparting a destaticizing effect.

Third, when a washing treatment with a detergent is conducted in place of the replacing treatment, ink-absorbing members and the like to be finally obtained may have disadvantages by reason of features inherent in fiber in some cases. More specifically, when a fiber mass is used as an ink-absorbing member, the ink-absorbing member has the following advantages. An ink-holding efficacy becomes high, since a proportion of the actual volume of the fiber occupied in a space of an ink container is low. Further, an ink-consuming efficiency becomes high, when a high-hydrophobic fiber material, for example, a polyolefin fiber material is used, because the hydrophobic nature develops a high ink-ejection property. In an ink-absorbing member using fiber, the product of an ink-absorbing capacity and ink-using efficiency increases by 20 to 40 percent compared with the conventional form typified by polyurethane foam. While the ink-absorbing member using the fiber has such the advantages, the hydrophobic fibrous material may cause a problem of lowering the easiness of ink charging due to the hydrophobic nature inherent in the fiber when an ink is charged. A method for solving such a problem includes a method of making the interior of an ink tank vacuous or decompressed. When the treatment with the EO-added glycol in the present invention is used, however, moderate hydrophilic nature can be imparted to the fiber, and so good easiness of ink charging can be imparted to the ink-absorbing member using such fiber without using any method of making the interior of an ink tank decompressed or vacuous.

The treatment with the EO-added glycol in the present invention may be conducted in a state that the ink-absorbing member has been housed in an ink tank. In this case, it is preferred that the formulation of an ink to be charged first be adjusted in view of the content of water remaining in the absorbing member after the treatment. Since in a general water-based ink, water accounts for the majority thereof, namely, 75 to 80% by weight as against 2 to 5% by weight of a dye, the content of water in a state that an ink has been filled into the tank is easy to adjust from the relation with the treatment with the treating agent containing the EO-added glycol.

The ink-absorbing member subjected to the treatment with the EO-added glycol as described above can be housed in a predetermined position of a basket which forms an ink tank container, thereby forming the ink tank container. Further, an ink-jet ink can be charged into the ink tank container to provide an ink tank.

The ink used herein is such that has a composition selected according to the desired form of recording. For example, an ink used as an ink-jet ink may be employed.

More specifically, those having a composition, in which on the basis of the above-described formulating ratio of the dye (coloring material) to water, 4 to 8% by weight of glycerol, 4 to 8% by weight of thiodiglycol, 4 to 8% by weight of urea as a humectant component, 2 to 4% by weight of isopropyl alcohol as a fixing-facilitating agent, and besides various optional additives such as a pH adjuster are further added, may be used.

The pH of an ink-jet ink is desirably within a range of from weak acidity to alkalinity, i.e., from at least 6 to lower than 11 for the purpose of further suppressing the influence of treatment oils and additives attached to or contained in a fibrous material in addition to the viewpoint of solubility of a dye and the like.

Figure 9:
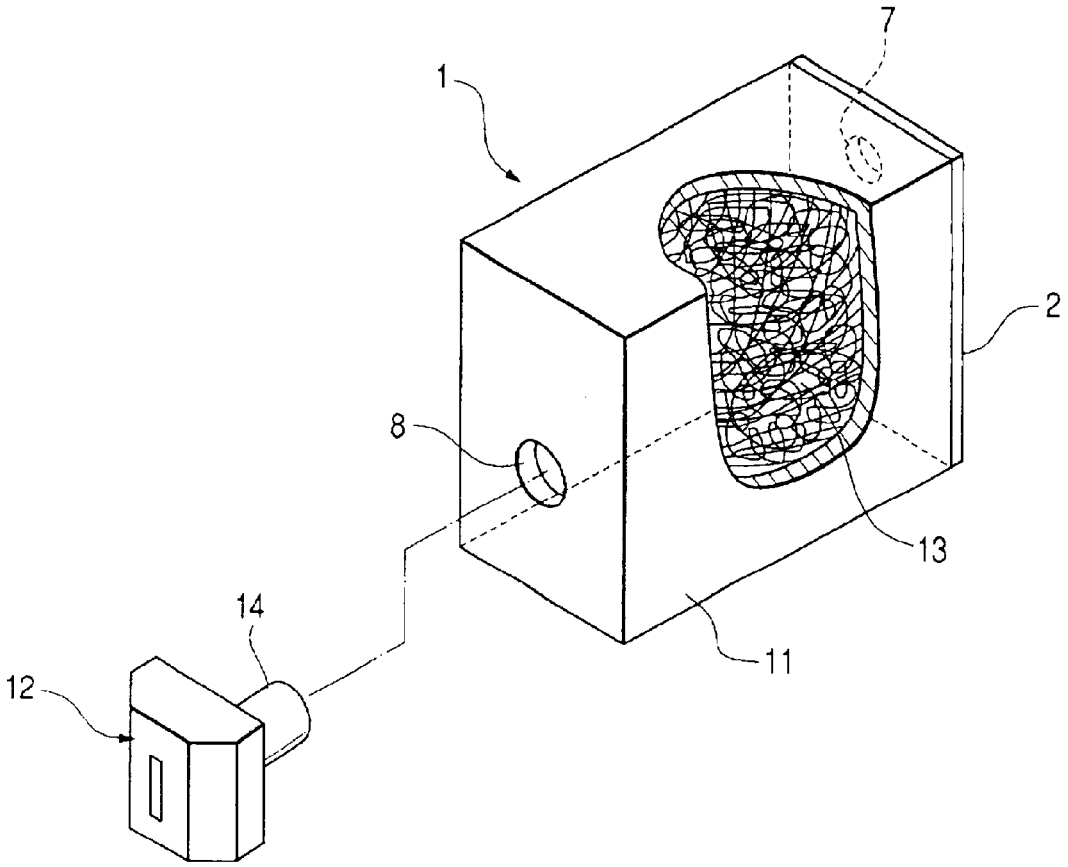
FIG. 9 illustrates a relationship between an ink tank and an ink-jet head.

An example of an ink tank container is illustrated in FIG. 9. The ink tank container 1 comprises a basket 11 in which an opening (communication part with the air) 7 communicating an internal space as an ink chamber with the air, and an ink feed opening 8 connected to an ink feed pipe 14 of an ink-jet head 12 are provided. An ink-absorbing member 13 is contained within a region functioning as the ink chamber surrounded by the basket 11 and a lid 2.

Figure 10A:
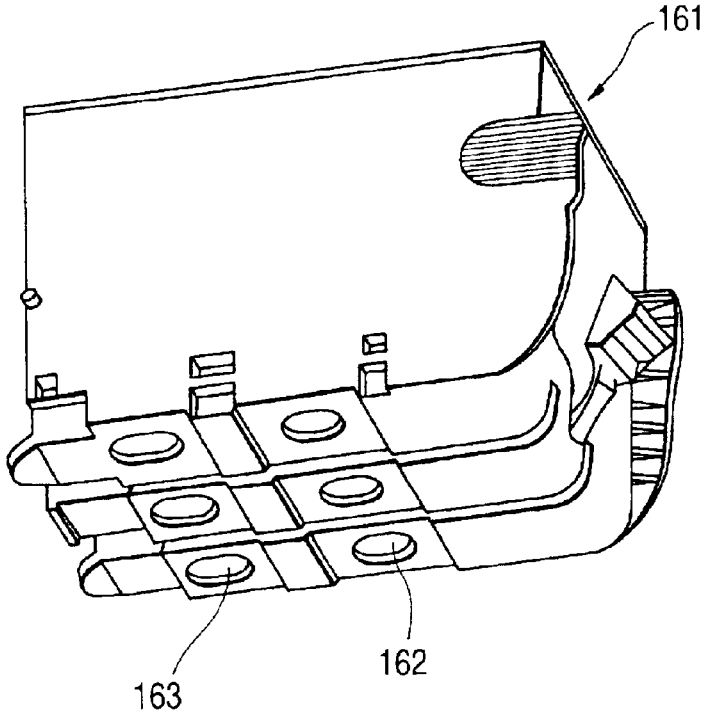
Figure 10B:
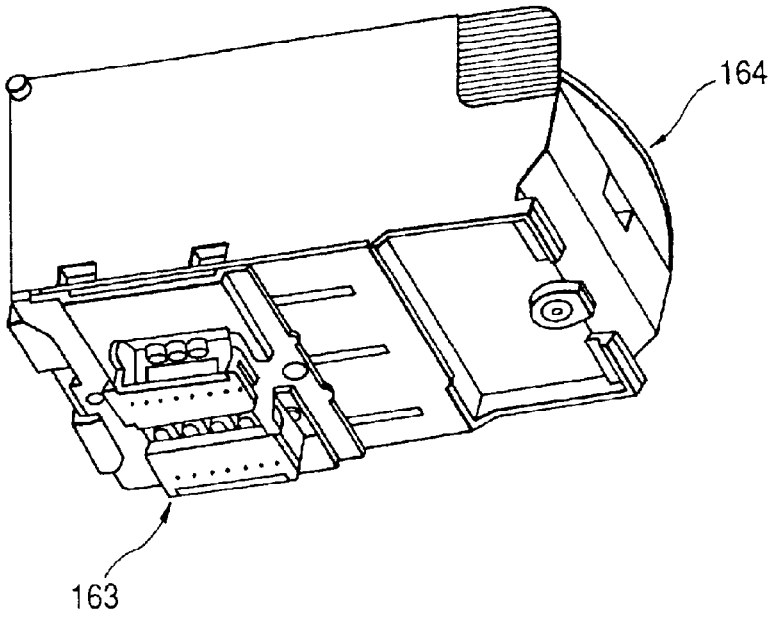
Figure 11A:
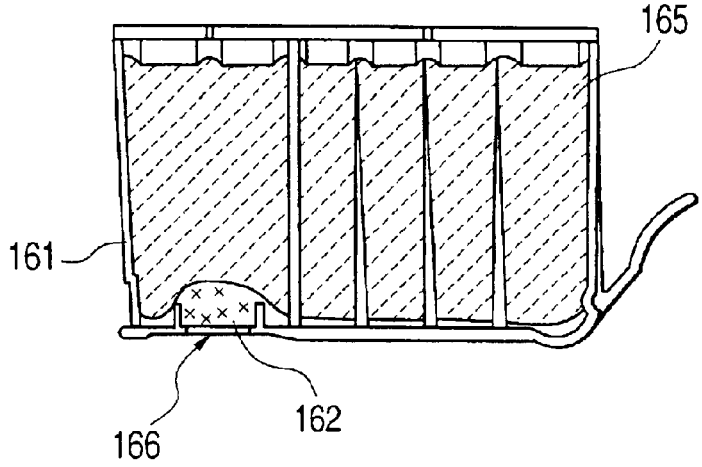
Figure 11B:
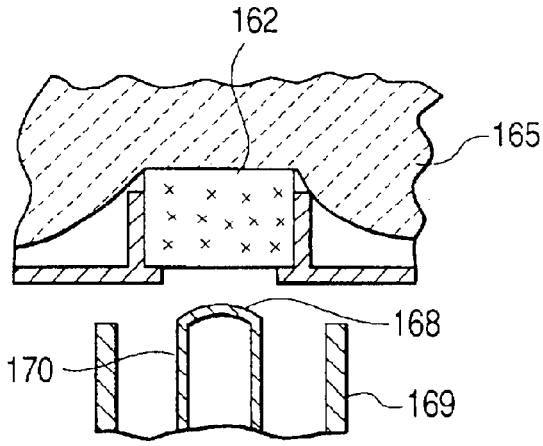
Figure 11C:
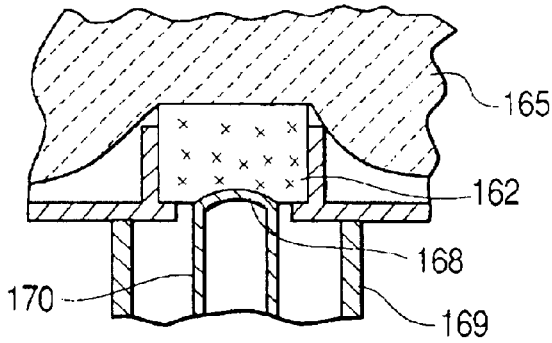
Figure 12:
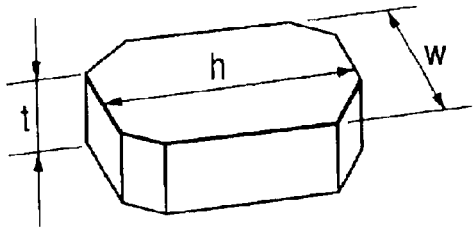
FIG. 12 illustrates an exemplary form of a joint member.
Figure 13:
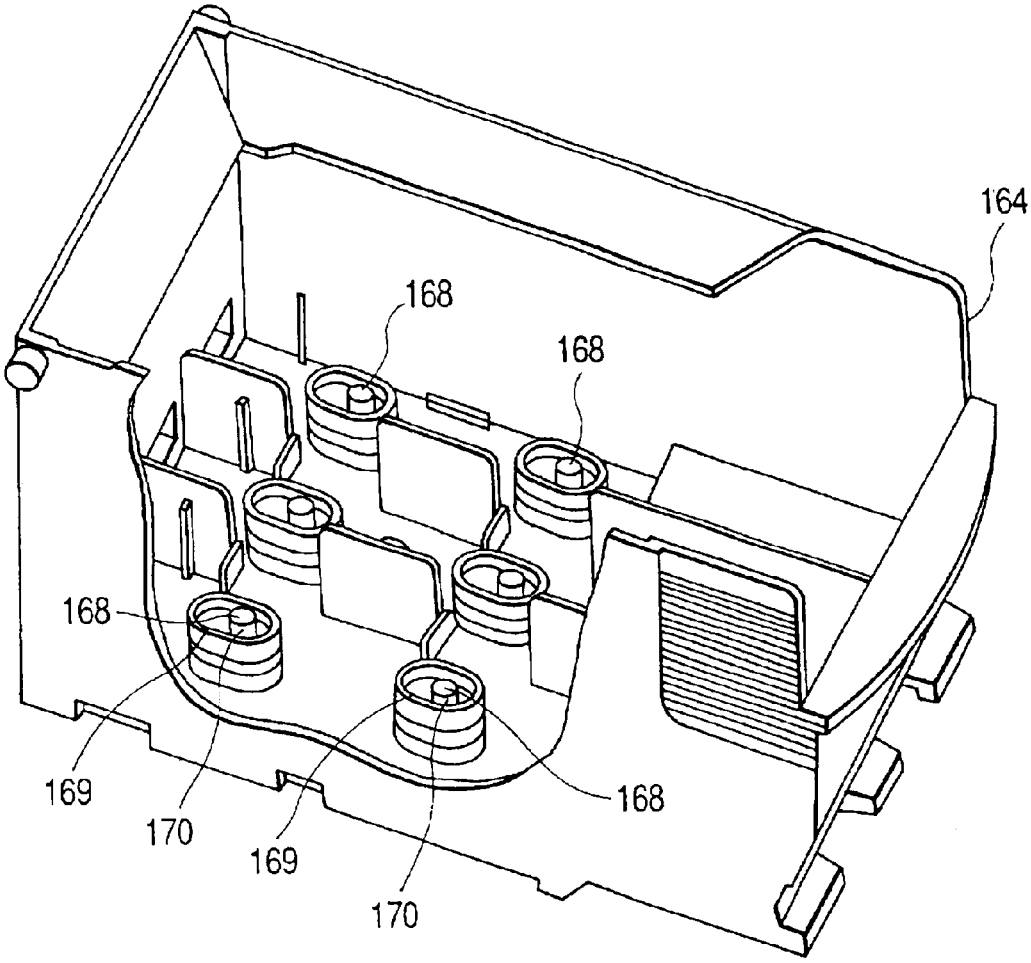
FIG. 13 illustrates the internal structure of a holder portion of an ink-jet cartridge.

FIGS. 10A, 10B, 11A to 11C, 12 and 13 illustrate examples of the construction of an ink-jet cartridge so constructed that an ink tank is detachably mounted in an ink-jet head. As illustrated in FIGS. 10A, 10B and 13, the ink-jet cartridge comprises an ink tank portion 161, an ink-jet head portion 163, and a holder portion 164 for fixing the ink-jet head 163 to construct a fitting part for the ink tank 161. As illustrated in FIG. 11A, an ink-absorbing member 165 having as its main object the storage of ink and another ink-absorbing member having a function as a joint member 162, which collects and holds the ink from the ink-absorbing member 165 by stronger capillary force than the ink-absorbing member 165 and effectively supplies the ink to the ink-jet head 163, are accommodated in the ink tank 161. Incidentally, the supply of the ink from the joint member 162 to the side of the ink-jet head is performed by producing negative pressure (reduced pressure) on the side of the ink-jet head 163 due to the ejection of the ink from an ejection opening of the ink-jet head 163.

The ink tank 161 and the holder portion 164 are so constructed that a filter portion 168 fusion-bonded to the ink tank 161 and the joint member incorporated into the ink tank 161 come into contact with each other in the form illustrated in FIGS. 11B and 11C so as to permit the supply of the ink from the ink tank 161 to the ink-jet head 163.

As illustrated in FIG. 11A, the joint member 162 is positioned and fixed by a guide within the ink tank 161 so as to come into contact with an opening 166 as the ink feed opening of the ink tank 161. With respect to the contact direction with the filter 168, the filter 168 is pressed against the opening surface of the opening 166 by the elastic force of the joint member 162. This elastic force allows the joint member 162 to stably press against the filter portion 168 even in a state in contact with the filter portion 168. Even when the depth of penetration of the filter 168 is a little, the contact of the ink feed opening 166 with the filter 168 can be surely conducted by arranging the joint member 162 in contact with the ink feed opening. Incidentally, reference numeral 169 indicates an elastic member provided around an ink feed pipe 170 so as to seal about the contact part of the joint member 162 with the filter 168. When the ink tank 161 is installed, this elastic member 169 is brought into close contact with the bottom of the ink tank 161, thereby preventing the ink from evaporating from the joint.

An ink-absorbing member composed of the above-described fibrous material can be preferably used for both the ink-absorbing member 165 and the joint member 162. However, in the case that only the joint member 162 is formed with the ink-absorbing member composed of the fibrous material, the ink-absorbing member 165 may be formed with urethane foam (sponge material) as usual.

When the fibrous material forming the ink-absorbing member is composed of the same material as those used for the basket and lid of the ink tank, for example, a polyolefin resin, availability in recycle can be enhanced.

FIG. 12 is a perspective view illustrating an example of the joint member 162 in FIGS. 11A to 11C. Reference symbols h, t and w denote height, thickness and width of the joint member, respectively.

Figure 14C:
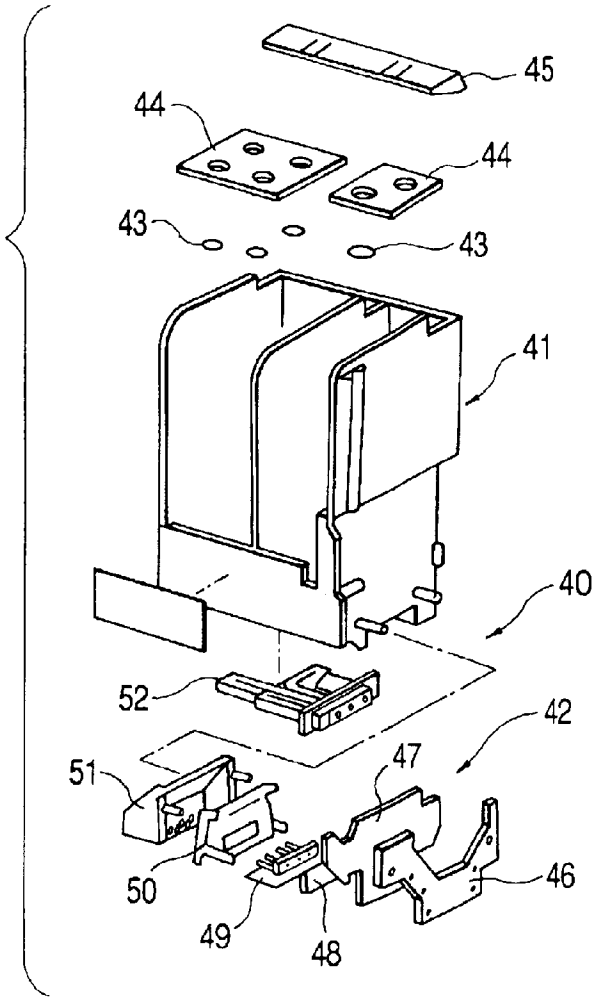
FIGS. 14A, 14B and 14C are assembly developments of an ink-jet cartridge.
Figure 14B:
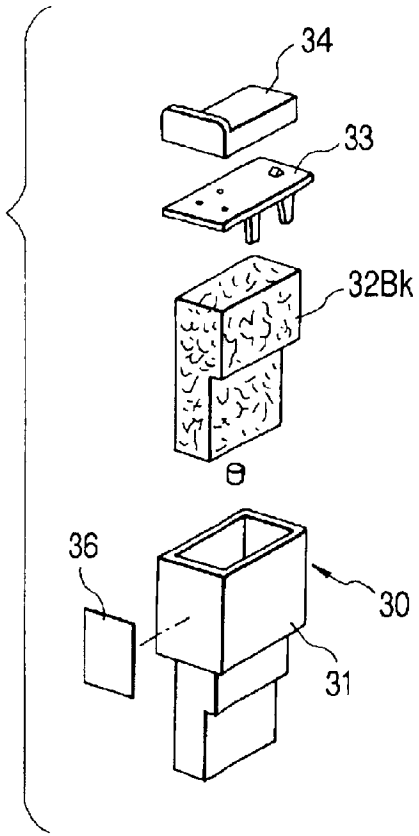
Figure 14A:
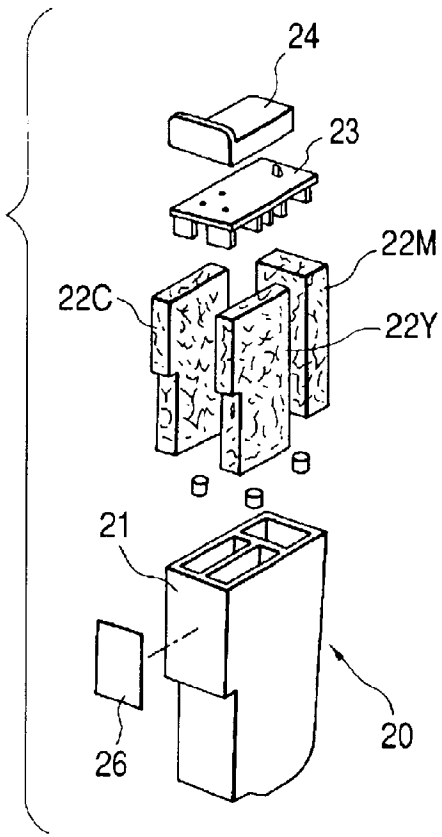

FIGS. 14A to 14C are assembly developments of an ink-jet cartridge. In this example, an ink cartridge capable of conducting 4-color recording is illustrated, in which an ink tank 20 with ink chambers for 3 colors integrally formed and an ink tank 30 for 1 color are detachably fitted in a holder 41.

FIG. 14A is an exploded view in perspective of a color ink tank 20 composed of three chambers. FIG. 14B is an exploded view in perspective of a black ink tank 30 having one chamber. FIG. 14C is an exploded view in perspective of an inkjet recording head 40 in which the respective replaceable ink tanks illustrated in FIGS. 14A and 14B can be installed.

The color ink tank 20 is roughly constructed by a tank body 21, ink-absorbing members 22Y, 22C, 22M containing needle punched felt fiber mass separately housed in 3 chambers in the tank body 21, a lid 23 for closing an opening of the tank body 21, and a grasping plate 24 fixed to one surface of the lid 23 for grasping the tank body 21. The ink-absorbing members 22Y, 22C, 22M are formed according to the shapes of the respective chambers and used for yellow, cyan and magenta inks, respectively. Reference numeral 26 indicates a label for indicating the contents of information of the ink tank.

In FIG. 14B, the black ink tank 30 is roughly constructed by a tank body 31, an ink-absorbing member 32Bk containing fiber mass housed in a chamber in the tank body 31, a lid 33 for closing an opening of the tank body 31, and a grasping plate 34 fixed to one surface of the lid 33 for grasping the tank body 31. Reference numeral 36 indicates a label for indicating the contents of information in the ink tank.

In FIG. 14C, the ink-jet recording head 40 is roughly constructed by an ink tank holder 41 in which the respective ink tanks described above are installed, and a recording head portion 42 installed in this holder 41. The tank holder 41 includes filters 43 fitted at the tips of ink feed pipes (not illustrated) inserted into ink feed openings (not illustrated) of the respective ink tanks for removing impurities in the respective inks, elastic members 44 as sealing members having as their main objects the prevention of evaporation of the inks after installing the tanks, and a blocking member 45 for fixing the tanks to the holder 41. The recording head portion 42 includes a base plate 46, a printed board 47, a heater board 48, a grooved top plate 49, a presser bar spring 50, a chip tank 51, and a flow path members 52.

Figure 15:
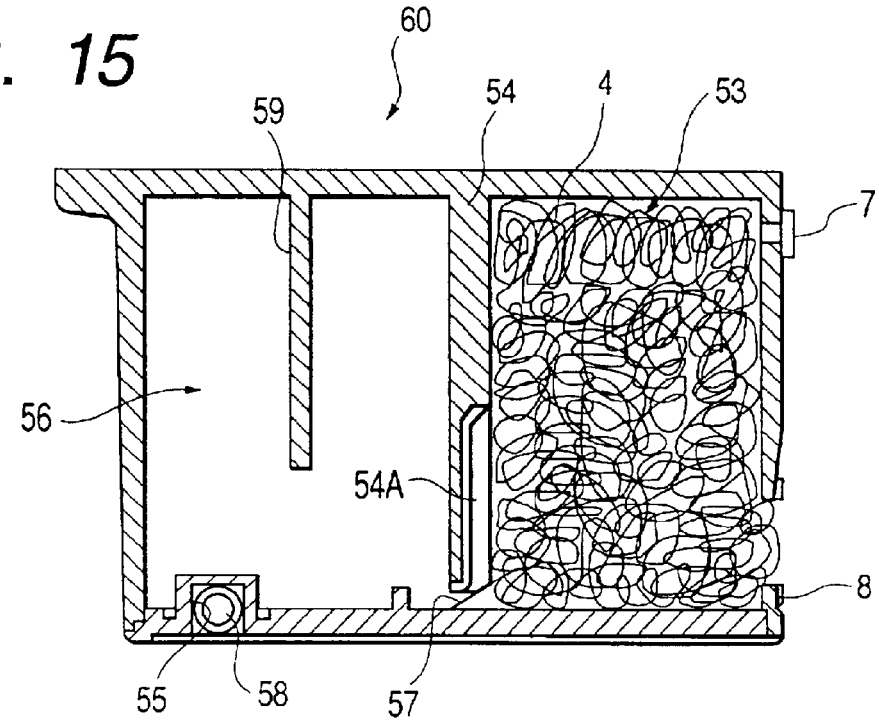
FIG. 15 is a cross-sectional view illustrating an example of the structure of an ink tank.

FIG. 15 is a cross-sectional view illustrating an another example of an ink tank used in such an ink-jet cartridge. As illustrated in FIG. 15, the ink tank 60 has an internal structure composed of two ink chambers which communicate with each other by means of a communication part 57 of a rib 54. A fibrous ink-absorbing member 4 as a negative pressure generating member is housed within a container portion 53 for negative pressure generating member as a first ink chamber. In a part of the wall of the container portion 53 for negative pressure generating member, are provided an ink feed opening 8 connected to an ink feed pipe of an ink-jet recording head (not illustrated), and a communication opening 7 for communicating the interior of the container portion 53 for negative pressure generating member with the air.

On the other hand, an opening 55 for filling the interior of the ink tank 60 with an ink is formed in the bottom of an ink container portion 56. A sealing member 58 is fitted into the opening 55. Reference numeral 59 is a reinforcement rib for the basket of the ink container portion 56.

In the rib 54 within the ink tank 60 of such a construction, the communication part 57 described above is formed in the vicinity of the bottom of the ink tank 60. A groove 54A extending from the vicinity of the communication part 57, through which gas-liquid exchange with the air introduced into the container portion 53 for negative pressure generating member through the communication opening 7 is conducted, is formed in the wall of the rib 54 on the side of the container portion 53 for negative pressure generating member. By such a construction, an ink in the ink container portion 53 is first consumed, and, when the level of the ink within the container portion 53 for negative pressure generating member almost reaches the groove 54A, the ink in the ink container portion 56 is fed to the container portion 53 for negative pressure generating member through the communication part 57 by the action of the gas-liquid exchange and the ink in the ink tank 60 begins to be consumed through the ink feed opening 8.

Figure 16:
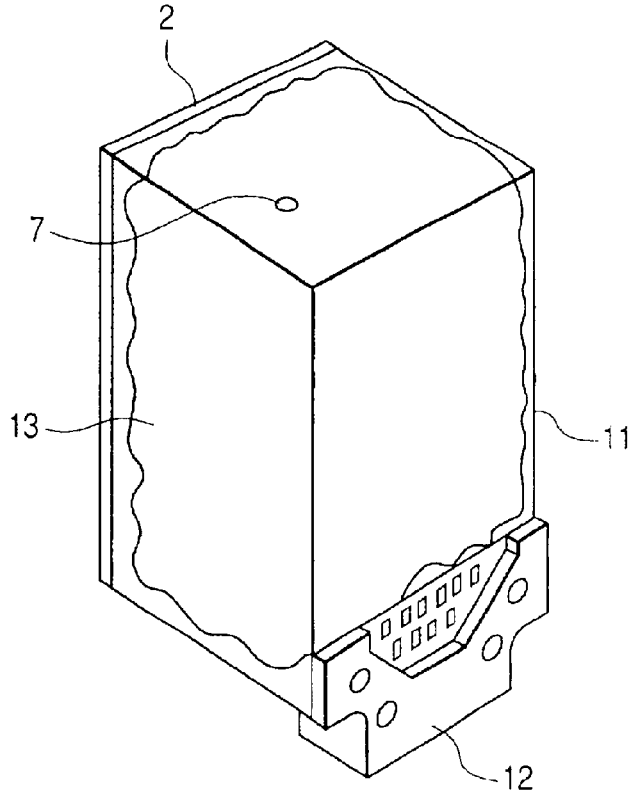
FIG. 16 illustrates an example of the structure of an ink-jet cartridge.

Another form of an inkjet cartridge is illustrated in FIG. 16. Similar to FIG. 9, this cartridge comprises a basket 11 closed by a lid 2, on which an opening (communication part with the air) 7 is provided for communicating an internal space as an ink chamber with the air, and an ink-absorbing member 13 contained in an ink tank connected to an ink-jet head 12.

Figure 20:
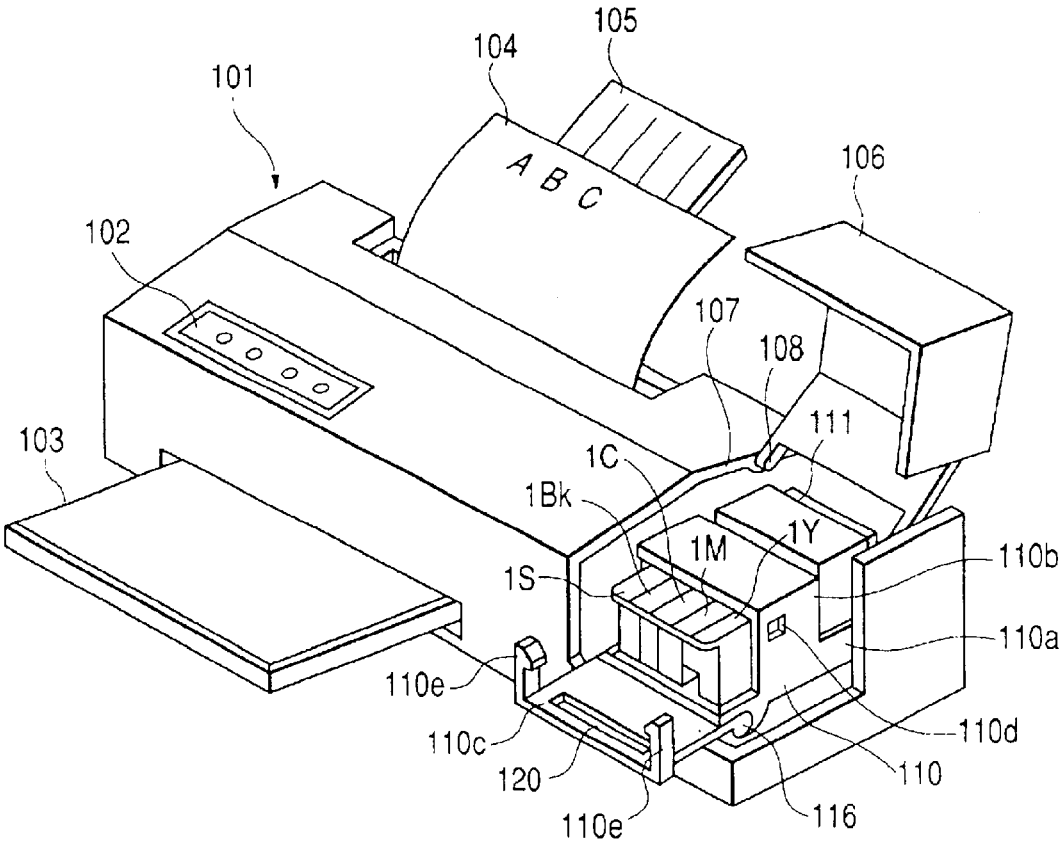
FIG. 20 is a perspective view illustrating an example of an ink-jet recording apparatus.

FIG. 20 is a perspective view illustrating an ink-jet recording apparatus to which the above-described ink tank or ink-jet cartridge can be applied. In FIG. 20, reference numeral 101 indicates a recording device (printer), 102 is an operation panel provided on an upper front surface of the housing of the printer 101, 103 is a paper cassette fitted through an opening provided in the front of the housing, 104 is paper (recording medium) fed from the paper cassette 103, and 105 is a discharge tray for holding paper discharged through a paper conveying path within the printer 101. Reference numeral 106 indicates a body cover of L-shaped cross-section. This body cover 106 covers an opening part 107 defined in the right front of the housing and is pivotably fitted in the inner ends within the opening part 107 by means of hinges 108. A carriage 110 supported by a guide (not illustrated) and the like is arranged in the interior of the housing. The carriage 110 is provided movably along the width direction of the paper passing through the paper conveying path, i.e. the longitudinal direction of the guide.

The carriage 110 is roughly constructed by a stage 110*a* horizontally held by the guide and the like, an opening part (not illustrated) formed in the vicinity of the guide on the stage 110*a* and adapted to fit an ink-jet head therein, a cartridge garage 110*b* for accommodating ink cartridges (ink tanks) 1Y, 1M, 1C, 1Bk and 1S mounted on the stage 110*a* in the front of the opening part, and a cartridge holder 110*c* for preventing the cartridges accommodated in the garage 110*b* from detaching.

The stage 110*a* is slidably supported at its rear part by the guide and mounted on a guide plate (not illustrated) on the bottom side of its front part. Incidentally, the guide plate may have a function that rises like a cantilever against a guide for preventing the rising of the paper conveyed through the paper conveying path The opening part of the stage 110*a* is so constructed that the ink-jet head (not illustrated) is installed with its ejection opening down. In the cartridge garage 110*b*, a through-opening is formed in the longitudinal direction thereof for accommodating 5 ink cartridges 1Y, 1M, 1C, 1Bk and 1S at the same time. Interlocking recesses 110*d*, with which interlocking claws 110*e* of the cartridge holder 110*c* interlock, are formed at outer side parts of the garage 110*b*. Reference numeral 111 is a cover for the ink-jet head.

On the other hand, the cartridge holder 110*c* is pivotably fitted at the front end of the stage 110*a* by means of hinges 116. A dimension from the front end of the garage 110*b* to the hinge 116 is determined in view of a dimension by which the ink cartridges 1Y, 1M, 1C, 1Bk and 1S project from the front end of the garage 110*b* when they are accommodated in the garage 110*b*. The cartridge holder 110*c* is roughly in the form of a rectangular plate. At the cartridge holder 110*c*, are provided a pair of interlocking claws 110*e* which project in a direction perpendicular to the plane of the plate at both ends of the upper part distant from the lower part fixed by the hinges 116 and interlock with the interlocking recesses 110*d* of the garage 110*b* when the cartridge holder 110*c* is closed. In the plate part of the cartridge holder 110*c*, is also formed fitting holes 120 for respectively fitting handgrips of the ink cartridges 1Y, 1M, 1C, 1Bk and 1S therein. The fitting holes 120 are respectively formed according to the positions, shapes and sizes of the handgrips.

As one application form of the ink-jet recording apparatus in the present invention, it is used integrally or separately as an image output terminal for an information processing equipment such as a ward processor or computer. Besides, it may be in the form of a copying machine combined with a reader or a facsimile terminal equipment having a transmitting and receiving function. Further, it may also be applied to a printing machine which makes a record on cloth and yarn.

The present invention will hereinafter be described more specifically by the following examples. However, the present invention is not limited to these examples.

EXAMPLE 1

A polypropylene fiber was produced under the following conditions according to the steps illustrated in FIGS. 3 and 4. Incidentally, a replacing treatment by a sprayer 180 before stretching is a treatment for replacing a treatment oil attached to an unstretched yarn by a treating agent by spraying the unstretched yarn with the treating agent. Process conditions other than the following conditions followed those used in the conventional method.

Composition of resin material: homopolypropylene;
Thickness of spun yarn: 18 deniers;
Spinning oil:

Anionic and nonionic blended treatment oil (mineral oil: 65% by weight; anionic surfactant: 15% by weight; nonionic surfactant: 20% by weight) which is a leading treatment oil for the ordinary production line;

Treating agent used in the sprayer:

2% by weight aqueous solution of polyoxyethylene sorbitan fatty acid ester (Treating Agent A) or a 5% by weight aqueous solution of polyoxyethylene acetylene glycol (number of moles of EO added: 30) (Treating Agent B);

Amount of the treating agent used in the replacing treatment by the sprayer:

30 liters/min at a process speed of 200 mm/sec and 200 g/sec;

Stretching temperature and degree of stretching:

80 to 90EC, 400%;

Finishing oil:

Nonionic treatment oil [containing 70% by weight of polyoxyethylene acetylene glycol (number of moles of EO added: 10)], coverage: 0.1% by weight based on fiber.

The thus-obtained staple fiber was subjected to a roughly fiber-opening treatment by means of a bale opener and then subjected to a fiber-opening treatment by means of a two-stage carding machine. A web discharged from an outlet of the carding machine was chopped into predetermined lengths, folded and accommodated in an ink tank container made of high-impact polystyrene. Thereafter, a lid was fixed to the container by ultrasonic welding. The thus-obtained ink-absorbing member composed of the polyethylene web accommodated in the container in the folded state was then filled with an ink having the following composition. The ink-absorbing member was used in an ink-jet recording apparatus to evaluate it. The results are shown in Table 1. Ink composition in the case where the fiber subjected to the replacing treatment with Treating Agent A by spraying was used:

| | |
|---|---|
| Dye | 4.0% by weight |
| Diethylene glycol | 7.5% by weight |
| Glycerol | 7.5% by weight |
| Urea | 7.5% by weight |
| Surfactant | 1.0% by weight |
| Isopropyl alcohol | 2.5% by weight |
| Water | Balance. |
| pH: 8.2. | |
| $\gamma$ = 32 dyn/cm. | |

Ink composition in the case where the fiber subjected to the replacing treatment with Treating Agent B by spraying was used:

| | |
|---|---|
| Dye | 2.5% by weight |
| Diethylene glycol | 5.0% by weight |
| Glycerol | 5.0% by weight |
| Urea | 5.0% by weight |
| Water | Balance. |
| pH: 9.0. | |
| γ = 47 dyn/cm. | |

Ink composition:

| | |
|---|---|
| Dye | 4.0% by weight |
| Diethylene glycol | 7.5% by weight |
| Glycerol | 7.5% by weight |
| Urea | 7.5% by weight |
| Surfactant | 1.0% by weight |
| Isopropyl alcohol | 2.5% by weight |
| Water | Balance. |
| pH: 8.2. | |
| γ = 32 dyn/cm. | |

TABLE 1

| | Spinning oil | Replacing treatment by spraying | Finishing oil | Slippage upon printing after left to stand at low humidity |
|---|---|---|---|---|
| Ex. 1 | | | | |
| Treating Agent A | Anionic and nonionic blended | Conducted | Nonionic | No problem arose |
| Treating Agent B | Anionic and nonionic blended | Conducted | Nonionic | No problem arose |
| Example 2 | Anionic and nonionic blended | Not conducted | Nonionic | Deposit occurred within a nozzle though no disorder occurred on opening face; slight slippage occurred, but still practicable without problems |
| Comp. Example 1 | Anionic and nonionic blended | Not conducted | Anionic and nonionic blended | Hydrophilic spots deposited near ejection opening of opening face; slippage occurred |

COMPARATIVE EXAMPLE 2

Fiber and an ink-absorbing member were produced in the same manner as in Example 1 except that the same anionic and nonionic blended treatment oil as that used in Example 1 was used as the spinning oil and finishing oil, and the unstretched yarn was not subjected to the replacing treatment by spraying. The thus-obtained ink-absorbing member was used in an ink-jet recording apparatus to evaluate it. The results are shown in Table 1. Ink composition:

| | |
|---|---|
| Dye | 2.5% by weight |
| Diethylene glycol | 5.0% by weight |
| Glycerol | 5.0% by weight |
| Urea | 5.0% by weight |
| Water | Balance. |
| pH: 9.0. | |
| γ = 47 dyn/cm. | |

EXAMPLE 2

Fiber and an ink-absorbing member were produced in the same manner as in Comparative Example 1 except that the finishing oil was changed to the same nonionic treatment oil as that used in Example 1. The thus-obtained ink-absorbing member was used in an ink-jet recording apparatus to evaluate it. The results are shown in Table 1.

As shown in Table 1, slippage upon printing was able to be prevented by using, as a finishing oil, the treatment oil containing polyoxyethylene acetylene glycol (number of moles of EO added: 10) which has an nonionic surface-active effect. Further, an effective treatment was feasible by adding the replacing treatment by spraying between the spinning step and the stretching step. Incidentally, when the EO-added glycol was added to the finishing oil, adverse influence on suitability for ink-jet by residual spinning oil was able to be eliminated even when the polyoxyethylene sorbitan fatty acid ester is used in the replacing treatment by spraying, since this compound has a strong solubilizing ability to the anionic and nonionic blended treatment oil to effectively limit the carrying of the treatment oil components in steps subsequent to the spray treatment.

When adverse influence due to hydrolysis of an ester or due to other reason is considered to be exerted on ink-jet inks designed to keep pH 6 to 11, it is more preferred to use the EO-added glycol as an nonionic surfactant.

Such replacing treatment by spraying is very simple even in selection of the treating agent and alteration of arrangements compared with selection of the treating agent and alteration of arrangements in a step of applying the treatment oil on the premise that it is applied to the surface of fiber, and so the improvement of operating efficiency in the line is brought about.

In Comparative Example 1, the finishing oil was predominantly attached to the finally obtained fiber. However, it was found that the spinning oil markedly remain on the fiber produced in the latter half of production lot, and such fiber involved the conventional problem in quality.

EXAMPLE 3

A fiber of core and shell structure was produced according to the steps illustrated in FIGS. 3 to 5 using an apparatus for forming fiber of core and shell structure as a melt spinning machine. In this example, a replacing treatment by a sprayer 180 before stretching was not conducted. Process conditions other than the following conditions followed those used in the conventional method.

Spun yarn:

Core: polyester, diameter: 15 im

Shell: Polyethylene, thickness: 3 im (overall inner diameter: 21 im)

Spinning oil:

60% of mineral oil, 25% of anionic surfactant and 15% of nonionic surfactant;

Treating agent used in the sprayer:

65% by weight of potassium alkyl phosphate, 10% by weight fatty acid ester, 25% by weight of silicone type smoothing agent; coverage: 0.5% by weight based on fiber;

Replacing treatment by spraying after crimping (treatment illustrated in FIG. 5):

Replacing treatment agent: ACETYLENOL E-H (trade name; product of Kawaken

Fine Chemicals Co., Ltd.)

Spraying conditions:

percent attachment of attached substance: 0.5% by weight based on fiber (amount of residual finishing oil: 0.02% by weight based on fiber).

The thus-obtained fibrous material was processed into staple fiber having a length of 64 mm. This staple fiber was used as a starting material to obtain felt (fiber density: 0.35 g/cm3) by a method using thermal adhesion and needle punching in combination. The thus-obtained felt was used as a joint member illustrated in FIG. 11B and incorporated into an ink tank. This ink tank was filled with an ink having the following composition and installed in an ink-jet apparatus to conduct a printing test. Ink composition:

| | |
|---|---|
| Dye | 3.0% by weight |
| Diethylene glycol | 5.0% by weight |
| Glycerol | 5.0% by weight |
| Urea | 5.0% by weight |
| Isopropyl alcohol | 4.0% by weight |
| Water | Balance. |
| pH: 8.7. | |
| $\gamma$ = 44 dyn/cm. | |

The printing test was conducted using an ink tank stored for 2 months in a dry environment at 60EC. The results are shown in Table 2.

EXAMPLE 4

The production of a joint member and evaluation thereof were performed in the same manner as in Example 3 except that the replacing treatment by spraying after the crimping was not conducted, and ACETYLENOL E-H was used as a finishing oil. The results are shown in Table 2.

COMPARATIVE EXAMPLE 2

The production of a joint member and evaluation thereof were performed in the same manner as in Example 3 except that an anionic treatment oil containing 65% by weight of potassium alkyl phosphate was used as a finishing oil. The results are shown in Table 2.

TABLE 2

| | Finishing oil | Replacing treatment by spraying after crimping | Ink ejection after left to stand for 2 years at ordinary temperature and humidity |
|---|---|---|---|
| Ex. 3 | Anionic | Conducted | No problem arose |
| Ex. 4 | Nonionic | Not conducted | No problem arose |
| Comp. Ex. 2 | Anionic | Not conducted | Deposit occurred on the upstream side; ejection failure often occurred |

As shown in Table 2, in comparison with the case (Comparative Example 2) where the finishing oil, which adversely affects ejection property if it remains attached on a fibrous material, was used, no problem arose on ink ejection in the cases where the replacing treatment with ACETYLENOL E-H by spraying was conducted (Example 3) and where the finishing oil was changed to ACETYLENOL E-H (Example 4). Incidentally, the process of Example 3 can use, as a finishing oil, a general-purpose finishing oil for production of fiber, which is used in application fields other than ink-jet. Therefore, the mere simple alteration of the process, in which the replacing treatment is added, permits the provision of a fibrous material, by which the conventional problem is solved though it is low in cost.

Incidentally, a felting step requires a treatment for bringing about a destaticizing effect for the purpose of achieving stable passability through a carding machine or the like though it varies a little according to its process setting. Auxiliary means such as a destaticizer and humidifier are also effective for such a treatment. However, from the viewpoint of avoiding increase of cost, it is preferred to use a treatment of applying a destaticizing agent to fiber by spray coating or the like. When the treating agent is uses as a diluted solution, however, for example, water is necessarily applied to the fiber. From such a point of view, ACETYLENOL E-H free of any solvent component is particularly preferred as a destaticizing agent and replacing treatment agent.

EXAMPLE 5

Figure 17:
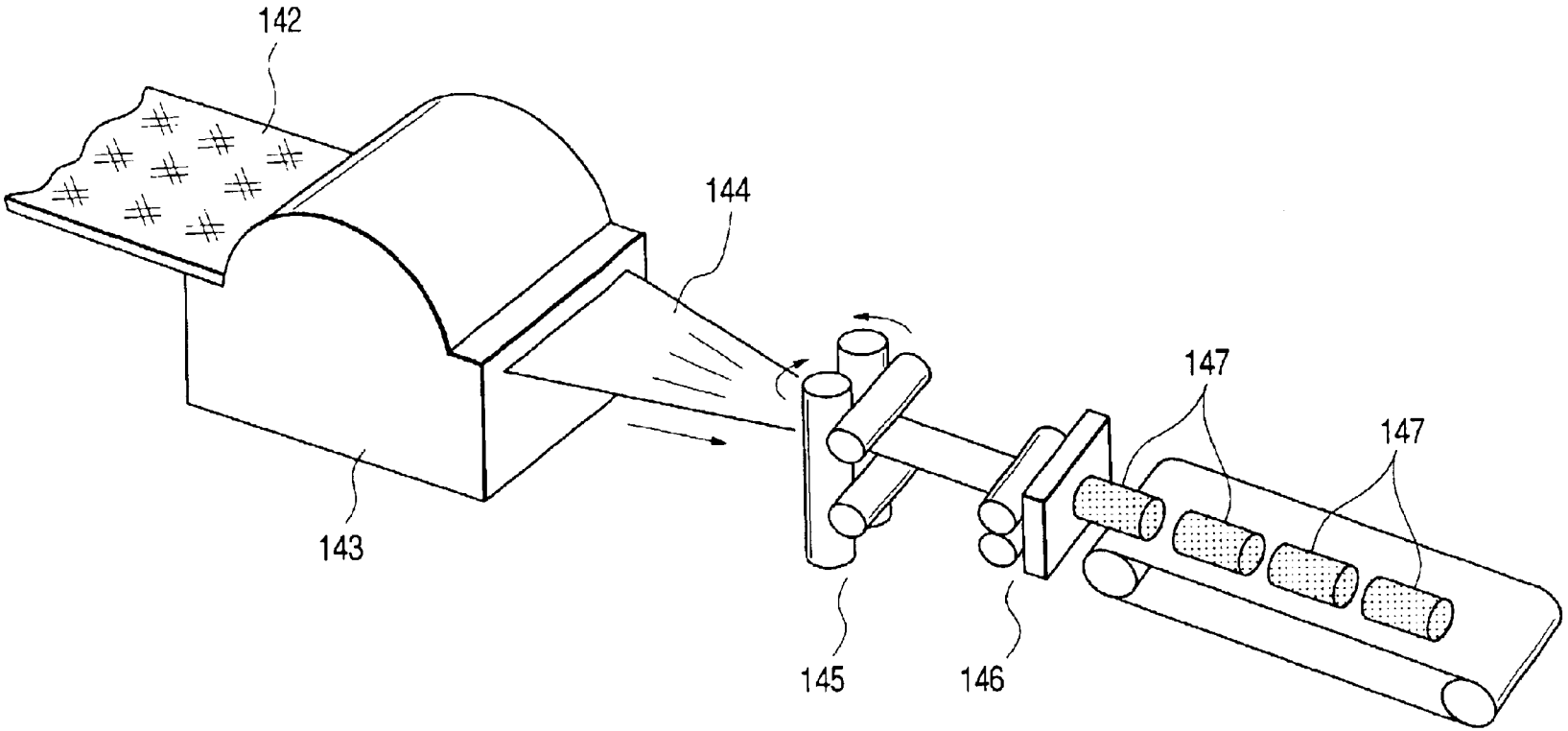
FIG. 17 illustrates an exemplary production process of an ink-absorbing member.
Figure 18:
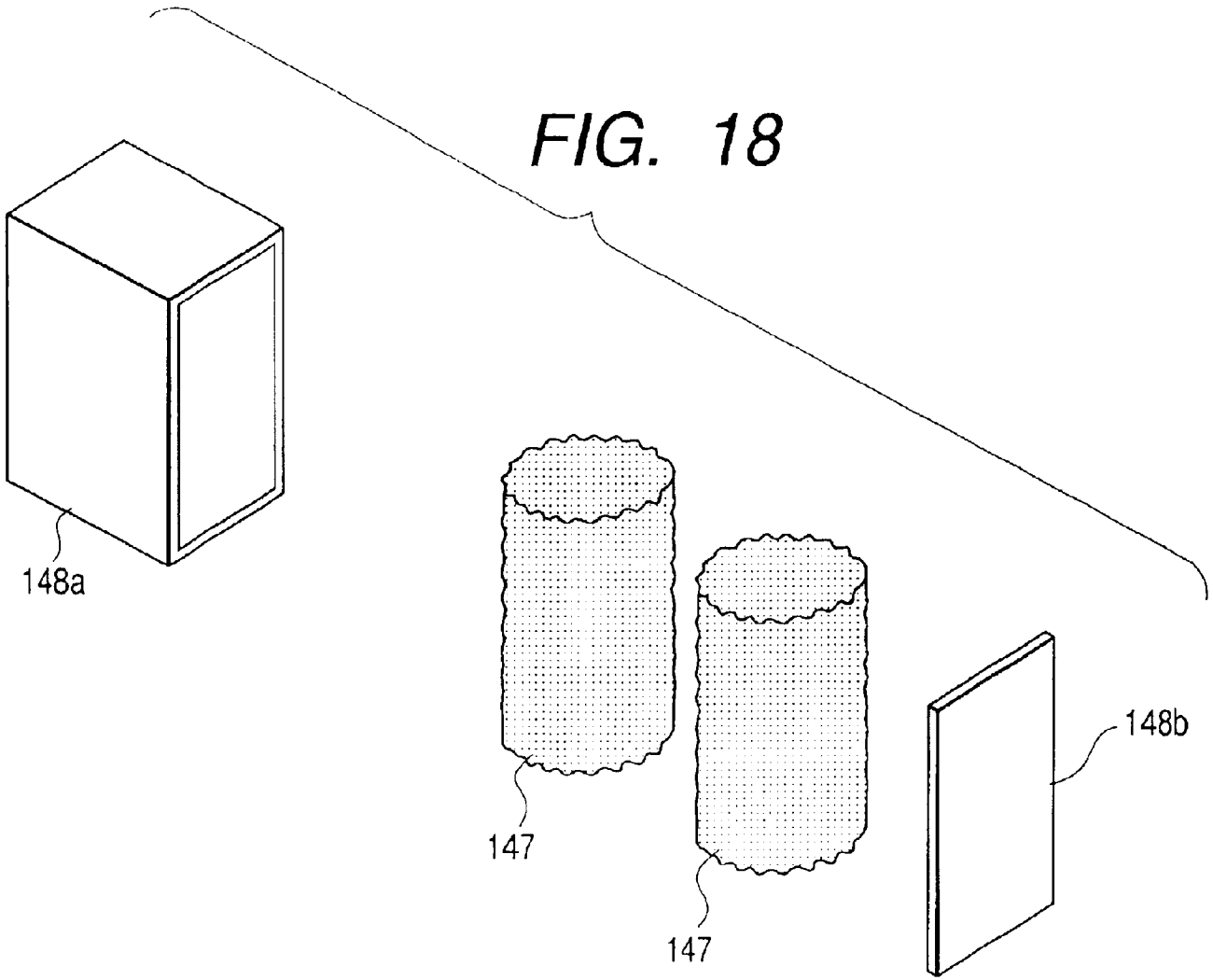
FIG. 18 illustrates the exemplary production process of the ink-absorbing member.
Figure 19:
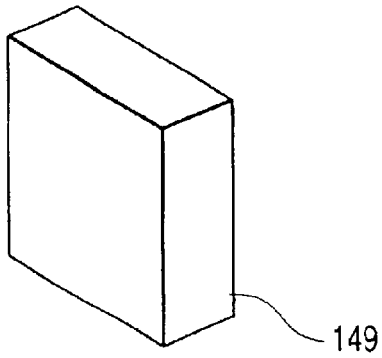
FIG. 19 illustrates the exemplary production process of the ink-absorbing member.

An ink-absorbing member was obtained in accordance with a production process of a hot-molded material as illustrated in FIGS. 17 to 19. The procedure thereof will hereinafter be described.

First of all, a continuous, elastic fiber aggregate in the form of a rod or plate was molded (first forming step). In this example, a blended staple fiber 142 containing a polypropylene fiber and a polyethylene fiber at a weight ratio of 7 to 3 was passed through a carding machine 143 illustrated in FIG. 17 to open intricately interlocking fibers into a sheet-like web 144 stable in density (mass/unit area), in which the fibers are arranged in parallel directions to one another. This web 144 was then bundled and passed through heating rollers 145 to heat-bond fibers in the surface layer of the bundle to one another, thereby forming a continuous fiber mass. The continuous fiber mass in this example is an aggregate of staple fibers because the carding machine is used.

The temperature of the heating rollers 145 may be optional so far as it is higher than the melting point of the polyethylene fiber, but lower than the melting point of the polypropylene fiber. However, it is preferred that the temperature be preset to a lower temperature as the contact time of the fibers with the heating rollers becomes longer, or a higher temperature as the contact time becomes shorter. For example, in the case of the polyethylene fiber having a melting point of 133EC, the temperature of the heated rollers is desirably preset to 135EC to 155EC. As a heating means, any means may be used so far as only the fibers in the surface layer can be heat-bonded. For example, heated air may be blown against the fibers. In the case where the heated air is used, it is preferred that the temperature be preset to a temperature higher than the case where the heating rollers are used.

In the case where the carding machine is used, a staple fiber mass is used as a raw material, and the starting material is usually fed to the carding machine through a fiber-opening step. However, the use of a tow as a raw material is more desirable because the fibers can be opened by cutting the tow and then conducting blast, and so the fiber-opening step can be omitted.

The continuous fiber mass is then cut by a cutter 146 into standard units to form fiber masses 147 (second forming step). The cut length is preferably almost the same as or somewhat longer than any side of a mold for an ink-absorbing member. This comes to almost the same length as its corresponding side of the resulting ink-absorbing member. Since upon compression of the fiber mass, it is more easily compressed in a direction almost perpendicular to a direction of fiber compared with the fiber direction, the fiber mass can be better compressed by controlling the length of the fiber mass as described above even when it is compressed into a complicated shape.

The fiber mass 147 with only the fibers in the surface layer thereof heat-bonded to one another is in such a state that fibers arranged in substantially the same direction are wrapped with a nonwoven fabric. Since the surface layer has strength in such a degree that handling in an automation process, such as conveyance, is easy, a production process of an ink-absorbing member, which will be described subsequently, becomes very easy. An ink-absorbing member is then molded with the above-described fiber mass. First of all, as illustrated in FIG. 18, a mold 148*a* formed in almost the same size as or a somewhat larger size than a container chamber for the ink-absorbing member in an ink tank is charged with the fiber mass 147 having a length almost equal to one side of the mold 148*a*. The number of the fiber mass 147 used may be one or more according to the volume of the ink tank.

As described above, the fiber mass 147 is in such a state that a fiber aggregate arranged in substantially the same direction is wrapped with a nonwoven fabric, then it may easily fit the form of the mold. After charging the fiber mass 147 with the mold 148*a*, a lid 148*b* is fitted as illustrated in FIG. 18. The fiber mass 147 is compressed in a fixed state by fitting the lid 148*b*. The mold 148*a* is then heated in a heating oven, whereby the fiber mass 147 is hot-molded into a shape of the mold to provide an ink-absorbing member 149 as shown in FIG. 19. The temperature of the heating oven may be optional so far as it is higher than the melting point of the polyethylene fiber, but lower than the melting point of the polypropylene fiber. For example, in the case where the melting point of the polyethylene fiber was 133EC, it was better that the temperature of the heating oven was 135EC to 155EC. The heating can be controlled according to necessary strength.

The polyethylene fiber melts by heating to serve as an adhesive, so that three-dimensionally interlocking intersections of the polypropylene fibers are fixed, thereby developing strength. Therefore, when high strength is required, it is better to heat the mold for a relatively long period of time until heat is completely transmitted to the interior of the fiber mass though it varies according to the shape of the ink-absorbing member. When softness is required, it is only necessary to heat the mold for a relatively short period of time so as not to completely transmit heat to the interior of the fiber mass. In this example, in order to fix intersections of the fibers up to the interior of the ink-absorbing member in the form of a rectangular parallelepiped of 40 nm H 60 mm H 50 mm in size, the heating was conducted at 140EC for 40 minutes. In the case where there is no need to fix the intersections up to the interior, the hot molding can be completed in a relatively short period of time by charging the mold with the fiber mass and then blowing heated air against the mold. In this case, it is preferred that holes be provided in the mold 148*a* and the lid 148*b* so as to facilitate the action of the heated air. In the case where it is intended to fix the intersections up to the interior, molding time can be shortened by first heating the fiber mass without charging it into the mold, and then charging it into the mold before it is completely cooled to compression mold it. The strength of the ink-absorbing member can be controlled by changing the mixing ratio of the polyethylene fiber to the polypropylene fiber. When high strength is required, it is only necessary to increase the amount of the polyethylene in the fiber mass. When softness is required on the other hand, it is only necessary to decrease the amount of the polyethylene in the fiber mass. The ink-absorbing member 149 thus molded is then removed from the mold as illustrated in FIG. 19. The ink-absorbing member thus produced is charged into an ink tank body, in which ink feed opening has been provided in advance, through an opening, and the opening is closed by a lid member (not illustrated) having a communication part with the air, thereby providing an ink tank.

As described above, the production process of the ink tank is divided into the step of forming the fiber mass and the step of charging the fiber mass into the mold to conduct hot molding. Therefore, this production process can be easily applied to ink-absorbing members of various shapes by changing the mold.

The thus-obtained ink-absorbing member was immersed for 10 minutes in a bath containing a 2% by weight aqueous solution of polyoxyethylene acetylene glycol (number of moles of EO added: 3) heated at 45EC to conduct a replacing treatment. Thereafter, the treating solution within the ink-absorbing member was fully removed, and the ink-absorbing member was then installed in an ink tank container and an ink is charged into it In this example, an investigation was made on ink-jet cartridges which can be selected according to the optimum need upon printing by exchanging a black ink cartridge capable of conducting high-speed monochrome printing, a cartridge generally used, and a 4-color photographic ink cartridge capable of obtaining a photographic image for one another. Therefore, the optional cartridges were subjected to a shelf test in storage boxes (15EC, 10% RH, for one month). The results are shown in Table 3.

EXAMPLE 6

The production of an ink-absorbing member and evaluation thereof were conducted in the same manner as in Example 5 except that the heat treatment of the fiber-molded material was conducted at 155EC for 40 minutes, and the replacing treatment was performed with a solution of 2% by weight of polyoxyethylene acetylene glycol (number of moles of EO added: 3) dissolved in a 0.1N NaOH aqueous solution. The results are shown in Table 3.

Referential Example 1

The production of an ink-absorbing member and evaluation thereof were conducted in the same manner as in Example 5 except that the ink-absorbing member was changed to that in the form of a rectangular parallelepiped of 20 mm H 30 mm H 50 mm in size, the heat treatment of the fiber-molded material was conducted at 140EC for 20 minutes, and the replacing treatment was not performed. The results are shown in Table 3.

Comparative Example 3

The production of an ink-absorbing member and evaluation thereof were conducted in the same manner as in Example 5 except that the replacing treatment was not performed. The results are shown in Table 3.

TABLE 3

| | Conditions of heat treatment | Replacing treatment | Result of test |
|---|---|---|---|
| Ex. 5 | 140° C., 40 min. | Conducted*1 | No problem arose |
| Ex. 6 | 155° C., 40 min. | Conducted*2 | No problem arose |
| Ref. Ex. 1 | 140° C., 20 min. | Not conducted | No problem arose |
| Comp. Ex. 3 | 140° C., 40 min. | Not conducted | Slight slippage upon printing; self-recovery was feasible by cleaning mechanism in printer |

*1 2% by weight aqueous solution of polyoxyethylene acetylene glycol (number of moles of EO added: 3);
*2 solution of 2% by weight of polyoxyethylene acetylene glycol (number of moles of EO added: 3) dissolved in a 0.1N NaOH aqueous solution.

As apparent from the comparison of Referential Example 1 with Comparative Example 3 in Table 3, it is understood that in the ink-absorbing members subjected to the heat-bonding step, slight slippage upon printing was observed when the heat treatment was conducted under severer conditions. This slippage upon printing can be solved by operating the cleaning mechanism (wiping and pumping) of a printer and hence becomes no problem in practical use when using a printer having such a cleaning mechanism. However, it is apparent that to solve such a problem without operating the cleaning mechanism contributes to efficient printing operation and simplification of printer mechanism.

Thus, it was possible to solve such a problem by conducting the replacing treatment with a 2% by weight aqueous solution of polyoxyethylene acetylene glycol (number of moles of EO added: 3) as shown in Example 5 in Table 3. Further, even when the heating was conducted under severer conditions, the use of an alkalified treating solution made it possible to more successfully cope with such a problem.

Since the slippage upon printing does not occur in Referential Example 1, the main cause of this problem is considered to be attributable to the additives contained in the starting resin itself, not to the treatment oil attached to the fibers.

EXAMPLE 7

A polypropylene fiber and a polyethylene fiber were produced under the following conditions according to the steps illustrated in FIGS. 3 and 4. Incidentally, a replacing treatment by a sprayer 180 before stretching was not conducted. Instead, an EO-added glycol was added to hot water in a hot water bath for stretching to replace additives and the like contained in filaments and possibly dissolved out by the EO-added glycol, thereby preventing the mixing of these additives into a finishing oil while retaining the bundling properties of the yarns in subsequent steps.

Although detailed description of process conditions is omitted, good ink-absorbing members were able to be obtained without being affected by the kinds of additives in the starting resins by using the replacing treatment with the EO-added glycol. In this example, a chopping step was provided before a bonding treatment, and it was effective to directly use the EO-added glycol as a lubricant for a cutter blade in addition to the lubricating effect of the EO-added glycol applied to the fibers on the cutter blade.

By the way, in some cases, the state of treatment in a central region of an ink-absorbing member may become poorer or more unstable as the size of the ink-absorbing member to be subjected to the replacing treatment right before contact with an ink becomes greater. Indeed, when the replacing treatment with the EO-added glycol was not conducted at stages between the production of a fibrous material and the production of an ink-absorbing member, but performed only in a state as an ink-absorbing member, the absorbing member was cut into dice after the treatment to subject the thus-obtained member pieces to an organic analysis by an infrared spectroscopic spectrum analysis or the like. As a result, it was found that the treatment in a central region of the ink-absorbing member may be insufficient in some cases, though it arises no practical problem.

On the other hand, when the replacing treatment with the EO-added glycol is also added in the production process, and such a treatment is conducted to the ink-absorbing member, the effect of the treatment can be achieved more uniformly, and moreover an ink-absorbing member having good properties can be provided. The reason for this is considered to be due to the fact that not only the penetrability into the ink-absorbing member and ability to dissolve out (or emulsify) dissolving-out components from the fiber of the treating agent itself upon the treatment of the ink-absorbing member are brought about, but also the high penetrability and susceptibility to the treatment are brought about upon the treatment of the ink-absorbing member from the treating agent, i.e., the EO-added glycol, applied in advance at the production stage of the fibrous material.

The alteration of the line like in this example, in which the replacing treatment with the EO-added glycol is added without changing the treatment oils, scarcely increases the complicatedness in process management and also scarcely affects production scale, kinds of treatment oils mixed in, cleanness after alteration of arrangements, and the like.

EXAMPLE 8

After polypropylene staple fiber of 3 deniers and staple fiber of 3 deniers having a polypropylene-polyethylene core and shell composite structure were tuft-blended at a weight ratio of 65:35, the blended fiber was formed into a web by a carding machine and then laminated in cross-layer. The laminate thus obtained was hot pressed (at 160EC) to obtain a molding having a thickness of 8 mm. A rectangular parallelepiped (t: 8 mm, w: 8.2 mm, h: 13.8 mm, density: 0.28 g/cm3) with its corners beveled in a perpendicular direction as illustrated in FIG. 12 was punched out of this molding by a biku-shaped die to obtain a felt-like replaceable joint member for an ink tank. In such a production process of felt, there are many steps that hate static electricity from the viewpoint of stabilizing steps such as a step of continuously producing a web. Therefore, it is commonly conducted to impart a destaticizing function to machines and fiber itself. In order to obtain the destaticizing function, typically, anionic surfactants are often used. In the felt-like joint member obtained in this example as well, an anionic surfactant was applied as a finishing oil to the polypropylene staple fiber and the polypropylene-polyethylene composite staple fiber in respective production steps thereof.

The joint member was immersed in a 2% by weight aqueous solution of ACETYLENOL E-H using purified water to treat it under stirring. Thereafter, the ink-absorbing member, i.e., the joint member, was taken out of the treating solution, rinsed with purified water and then dewatered by a centrifugal treatment.

In order to confirm the effect of the treatment, a 2% by weight aqueous solution of ACETYLENOL E-H (using purified water) was permeated through the ink-absorbing member after the dewatering treatment, and then the permeated solution was subjected to quantitative analysis on Si (silicon), P (phosphorus) and K (potassium), which were characteristic elements contained in typical anionic surfactants as phosphates and potassium salts, by means of an ICP analysis (plasma emission spectrometer). The results are shown in Table 4.

With respect to an untreated ink-absorbing member, a 2% by weight aqueous solution of ACETYLENOL E-H (using purified water) was permeated therethrough in the same manner as described above, and then analysis was conducted as to the permeated solution. Further, the effects of the treatment were evaluated as to cases where no stirring was conducted and where stirring conditions were varied in the same manner as described above. The results are shown in Table 4.

TABLE 4

| Treating conditions | Sample No. | Si (ppm) | P (ppm) | K (ppm) |
|---|---|---|---|---|
| Untreated | 1 | 0.731 | 15.818 | 22.668 |
| | 2 | 0.798 | 17.441 | 25.027 |
| | (Average) | 0.765 | 16.630 | 23.848 |
| Stirred for 6 minutes | 1 | 0.114 | 0.247 | 0 |
| | 2 | 0.088 | 0.651 | 0 |
| | (Average) | 0.101 | 0.449 | 0.000 |
| Stirred for 12 minutes | 1 | 0.083 | 0.297 | 0 |
| | 2 | 0.095 | 0.369 | 0.143 |
| | (Average) | 0.089 | 0.333 | 0.072 |
| Stirred for 24 minutes | 1 | 0.064 | 0.641 | 0.137 |
| | 2 | 0.074 | 0.274 | 0.002 |
| | (Average) | 0.069 | 0.458 | 0.070 |
| Immersed for 24 hours, Not stirred | 1 | 0.077 | 0.383 | 0 |
| | 2 | 0.066 | 0.402 | 0 |
| | 3 | 0.109 | 0.786 | 0.251 |
| | 4 | 0.133 | 0.841 | 0.083 |
| | (Average) | 0.096 | 0.603 | 0.084 |

As apparent from the result shown in Table 4, it is understood that silicon, phosphorus, potassium are almost removed by the replacing treatment with the Acetylenol solution under all the conditions. With respect to components of the treatment oils other than these elements, it is considered that they are removed from the joint members like the detected elements, since the components of the treatment oils do not separate from each other, but are complexes. Ink cartridges separately using the joint members treated under these conditions were used to actually conduct a printing test. As a result, it was confirmed that the predetermined number of sheets printed until life is maintained in any cartridge. Incidentally, Acetylenol is suitable for a component of inks. Therefore, even when Acetylenol in the treating agent and a slight amount of the treatment oils remain in the ink-absorbing member, no disadvantage arises since such treatment oils are solubilized or emulsified.

In this example, the effect of replacing the dissolving-out components is evaluated using metal ions as indices. In a case where the dissolving-out component is, for example, a nonionic treatment oil, however, the effect can also be evaluated using, as an index, an analysis of a carbonyl group, ethylene chain, imino group and/or the like by means of an infrared spectroscopic spectrum. To control the metal ions to 1 ppm or lower by the determination is regarded as being required to replace the dissolving-out components to 20 to 100 ppm or lower. The treatment in this example is not limited to the treatment of newly produced fibers and ink-absorbing members, but may be applied as a treating method for replacing a residual ink in, for example, spent ink-absorbing members as shown in Example 9 which will be described subsequently.

EXAMPLE 9

Ink-absorbing members 32 (using the hot-molded material described in Example 5) in ink cartridges (having the construction illustrated in FIG. 14B) collected from users were treated. It is general that at least about 10% of an ink contained before use remains in each ink-absorbing member as a residual ink after use, and that evaporation of the ink is allowed to progress and the residue is hence further lowered depending on shelf environments after that, collecting environments and the like. The ink-absorbing members (including a case where water and the like are evaporated to increase in viscosity) with such a residual ink held therein were treated with an EO-added glycol.

The ink-absorbing member was first taken out of an ink tank container and immersed in a 2% by weight aqueous solution of ACETYLENOL E-H using purified water, thereby treating it. Treating conditions were preset to 40EC and 1 hours, and dewatering was conducted repeatedly 5 times. Finally, the absorbing member was rinsed with a 0.1% by weight aqueous solution of the same agent, dewatered and then dried at 60EC for 2 hours, thereby obtaining a regenerated ink-absorbing member.

The residual ink was replaced by this treatment. The amount thereof was less than 10 ppm, which could be confirmed by at quantitative analysis using S in a dye as an index. Thereafter, the ink-absorbing member was accommodated in a new ink tank container, and an ink of the same kind was charged therein, whereby the ink-absorbing member was able to be reused.

Incidentally, this regenerating treatment of the ink-absorbing member may be conducted in a state that the ink-absorbing member has been fitted in the ink tank container so far as no abnormality occurs on the positioning part and the like of an ink-jet cartridge, and so it can be reused. As a method of replacing treatment in this case, may be selected a method in which charging of the treating solution from an ink feed opening and removal from a joint opening to a recording head portion are intermittently or continuously repeated.

When ink-absorbing members of the same shape for yellow, magenta and cyan inks as illustrated in FIG. 14A were collected, any ink was able to be charged after the replacing treatment irrespective of the color of the ink filled initially. In this case, a color difference was within tolerance limits.

By the way, in the absorbing members composed of urethane foam heretofore in common use, there is no effective means for treating them in view of even thickened inks. In addition, since the urethane foam itself is dyed with the ink, it has been hard to be used for a transparent ink tank even though a dyeing component is redissolved out and so no color difference is brought. Further, since the urethane foam itself undergoes hydrolysis while it contains the ink for a long period of time, it has been hard to be reused though it may sufficiently fit for the first use. On the contrary, the ink-absorbing member composed of a polyolefin type fibrous material can be reused since the fibrous material itself is stable and moreover has a merit that it is not dyed. Accordingly, the ink-absorbing member can be reused by conducting the treatment of the residual ink according to the present invention.

As understood from the above description, the present invention can provide fibrous materials which incur no increase in cost while eliminating the influence of treatment oils mixed in upon alteration of arrangements, and the like, and the production process thereof. In addition, the present invention can provide fibrous materials which incur no increase in cost while eliminating the influence of additives for their starting resins or denatured substances thereof, which may possibly dissolve out in a spinning step, or additives or denatured substances thereof, which become easy to be dissolved out by the heat treatment and the like subjected up to the use of the fibrous materials as members with which an ink comes into contact, and the production process thereof.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process for producing a fibrous material comprising:

providing a spun yarn by melt spinning a thermoplastic resin; and subjecting the spun yarn to a glycol treatment in which the spun yarn is contacted with an ethylene oxide adduct of a glycol having a cloud point of at least 65° C., whereby at least some releasable components of the spun yarn are emulsified or made water-soluble by the glycol treatment.

2. The process according to claim 1, wherein the glycol treatment is at least one treatment selected from among (1) a treatment for applying the glycol to the yarn;

(2) a treatment for replacing a releasable component releasable into an ink in the yarn by the glycol to reduce an amount of the releasable component; and (3) a treatment for dissolving or emulsifying the releasable component in the yarn in the glycol.

3. The process according to claim 1 or 2, which comprises steps of:

treating a melt spun yarn with a spinning oil, stretching the resultant unstretched yarn, and treating the stretched yarn with a finishing oil.

4. The process according to claim 3, wherein the glycol treatment is conducted as at least one step selected from among a) a step of contacting a spun yarn with the glycol which is contained in a spinning oil at the time of melt spinning to apply the glycol to the spun yarn;

b) a step of contacting an unstretched yarn with a treating agent containing the glycol after melt spinning;

c) a step of contacting an unstretched melt spun yarn with a treating agent containing the glycol during a step of stretching the unstretched yarn;

d) a step of contacting a stretched yarn with the glycol which is contained in a finishing oil; and e) a step of contacting a yarn obtained after the stretching with a treating agent containing the glycol.

5. The process according to claim 4, wherein the content of the glycol in the spinning oil in the step a) or in the finishing oil in the step d) is at least 80% by weight.

6. The process according to claim 4, wherein the releasable component in the yarn is at least one of additives contained in the thermoplastic resin which constitutes the yarn and components derived from the spinning oil and finishing oil attached to the yarn.

7. The process according to claim 1, wherein the glycol is an acetylene glycol having a triple bond, and having at least one side chain at a central site of a linear main chain, with ethylene oxide added to the side chain.

8. The process according to claim 7, wherein the glycol exhibits a nonionic surface activity.

9. The process according to claim 7, wherein the glycol is an ethylene oxide adduct of 2,4,7,9-tetramethyl-5-decyn-4,7-diol, in which the number of moles of ethylene oxide added is from 3 to 30.

10. The process according to claim 9, wherein the treating agent containing the glycol is composed of the glycol alone.

11. The process according to any claim 10, wherein the thermoplastic resin is at least one selected from the group consisting of polyethylene, polypropylene, ethylene-propylene copolymers, polymethylpentene and ethylene-olefin copolymers.

12. The process according to claim 1 or 11, wherein the thermoplastic resin is a resin for obtaining a heat-adhesive fibrous material.

13. The process according to claim 12, wherein the glycol is combined with a lubricant for a cutter blade for fiber or a lubricant for a sliding part of a mold for a hot-molded material.

14. A fibrous material produced in accordance with the production process according to claim 1.

15. An ink-absorbing member constructed to deliverably hold an ink-jet ink therein, comprising the fibrous material according to claim 14.

16. A fibrous material composed of a thermoplastic resin, which is treated by a glycol treatment in which an ethylene oxide adduct of a glycol having a cloud point of at least 65° C. is added, whereby at least some releasable components of the thermoplastic resin are emulsified or made water-soluble by the glycol treatment.

17. The fibrous material according to claim 16, wherein the thermoplastic resin is at least one selected from the group consisting of polyethylene, polypropylene, ethylene-propylene copolymers, polymethylpentene and ethylene-olefin copolymers.

18. The fibrous material according to claim 16 or 17, wherein the thermoplastic resin is a resin for obtaining a heat-adhesive fibrous material.

19. The fibrous material according to claim 18, wherein the glycol is acetylene glycol having a triple bond, and having at least one side chain at a central site of a linear main chain, with ethylene oxide added to the side chain.

20. The fibrous material according to claim 19, wherein the glycol exhibits an annonionic surface activity.

21. The fibrous material according to claim 19, wherein the glycol is an ethylene oxide adduct of 2,4,7,9-tetramethyl-5-decyn-4,7-diol, in which the number of moles of ethylene oxide added is from 3 to 30.

22. An ink-absorbing member constructed to deliverably hold an ink-jet ink therein, comprising the fibrous material according to claim 16.

23. A process for treating an ink-absorbing member which can deliverably hold an ink-jet ink therein, the process comprising the steps of:

treating a molding comprising a fibrous material composed of a thermoplastic resin with a treating agent containing an ethylene oxide adduct of a glycol having a cloud point of at least 65° C., whereby at least some releasable components of the thermoplastic resin are emulsified or made water-soluble by the treating agent.

24. The process according to claim 23, wherein the glycol is an acetylene glycol having a triple bond, and having at least one side chain at a central site of a linear main chain, with ethylene oxide added to the side chain.

25. The process according to claim 24, wherein the glycol exhibits a nonionic surface activity.

26. The process according to claim 24, wherein the glycol is an ethylene oxide adduct of 2,4,7,9-tetramethyl-5-decyn-4,7-diol, in which the number of moles of ethylene oxide added is from 3 to 30.

27. The process according to claim 26, wherein the treating agent containing the glycol is composed of the glycol alone.

28. The process according to claim 27, wherein the glycol is used in combination with an aqueous solution of an alkali.

29. The process according to claim 28, wherein the aqueous solution of the alkali is an aqueous solution of sodium hydroxide, potassium hydroxide or lithium hydroxide.

30. The process according to claim 23, wherein the thermoplastic resin is at least one selected from the group consisting of polyethylene, polypropylene, ethylene-propylene copolymers, polymethylpentene and ethylene-olefin copolymers.

31. The process according to claim 30, wherein the thermoplastic resin is a resin for obtaining a heat-adhesive fibrous material.

32. An ink tank container for an inkjet head comprising an ink chamber having an opening part communicating with air and an ink feed opening connecting to the ink-jet bead, wherein the ink-absorbing member according to either one of claim 15 or 22 is fitted within a region including the ink feed opening in the ink chamber.

33. The ink tank container according to claim 32, wherein the ink-absorbing member is provided in contact with the ink feed opening.

34. An ink tank container for an ink-jet head comprising an ink chamber having an opening part communicating with air, and a connecting chamber connectable to the ink-jet head, the connecting chamber communicating with the ink chamber and being constructed to feed an ink from the ink chamber to the ink-jet head through a connecting opening to the ink-jet head, wherein the ink-absorbing member according to either one of claim 15 or 22 is fitted within the connecting chamber for providing a negative pressure.

35. The ink tank container according to claim 34, wherein the ink-absorbing member is provided in contact with the connecting opening.

36. An ink tank in which an ink-jet ink is charged into the ink chamber of the ink tank container according to claim 34.

37. An ink-jet cartridge comprising the ink tank according to claim 36 and an ink-jet head for ejecting an ink contained in the ink tank on a recording medium to conduct recording.

38. An ink-jet apparatus comprising the ink-jet cartridge according to claim 37 and a carriage on which the ink-jet cartridge is detachably mounted.

39. A treating process for regenerating ink absorbing properties of an ink-absorbing member composed principally of a fibrous material, the process comprising the step of:

treating the ink-absorbing member with a residual ink held therein with a treating agent containing an ethylene oxide adduct of a glycol having a cloud point of at least 65° C., whereby at least some releasable components of the fibrous material are emulsified or made water-soluble by the treating agent.

40. The process according to claim 39, wherein the glycol is an acetylene glycol having a triple bond, and having at least one side chain at a central site of a linear main chain, with ethylene oxide added to the side chain.

41. The process according to claim 40, wherein the glycol exhibits nonionic surface activity.

42. The process according to claim 40, wherein the glycol is an ethylene oxide adduct of 2,4,7,9-tetramethyl-5-decyn-4,7-diol, in which the number of moles of ethylene oxide added is from 3 to 30.

43. The process according to any one of claims 39 to 42, wherein the treating agent containing the glycol is composed of the glycol alone.

44. The process according to claim 43, wherein the glycol is used in combination with an aqueous solution of an alkali.

45. The process according to claim 44, wherein the aqueous solution of the alkali is an aqueous solution of sodium hydroxide, potassium hydroxide or lithium hydroxide.

46. The process according to claim 45, wherein the thermoplastic resin is at least one selected from the group consisting of polyethylene, polypropylene, ethylene-propylene copolymers, polymethylpentene and ethylene-olefin copolymers.

47. The process according to claim 46, wherein the fibrous material is a heat-adhesive fibrous material.

48. An ink jet contacting member comprising the fibrous material according to claim 14.

49. The fibrous material according to claim 14, wherein the glycol is an acetylene glycol having a triple bond, and having at least one side chain at a central site of a linear main chain, with ethylene oxide added to the side chain.

50. The fibrous material according to claim 49, wherein the glycol exhibits a nonionic surface activity.

51. The fibrous material according to claim 49, wherein the glycol is an ethylene oxide adduct of 2,4,7,9-tetramethyl-5-decyn-4,7-diol, in which the number of moles of ethylene oxide is from 3 to 30.

52. The fibrous material according to claim 14, wherein the thermoplastic resin is at least one selected from the group consisting of polyethylene, polypropylene, ethylene-propylene copolymers, polymethylpentene and ethylene-olefin copolymers.

53. An ink contacting member comprising the fibrous material according to claim 16.

54. The ink contacting member according to claim 53, wherein the glycol is an acetylene glycol having a triple bond, and having at least one side chain at a central site of a linear main chain, with ethylene oxide added to the side chain.

55. The ink contacting member according to claim 54, wherein the glycol exhibits a nonionic surface activity.

56. The ink contacting member according to claim 54, wherein the glycol is an ethylene oxide adduct of 2,4,7,9-tetramethyl-5-decyn-4,7-diol, in which the number of moles of ethylene oxide is from 3 to 30.

57. The ink contacting member according to claim 53, wherein the thermoplastic resin is at least one selected from the group consisting of polyethylene, polypropylene, ethylene-propylene copolymers, polymethylpentene and ethylene-olefin copolymers.

58. The process of claim 1, wherein the glycol has a cloud point of at least 80° C.

59. The fibrous material of claim 14, wherein the glycol has a cloud point of at least 80° C.

60. The fibrous material of claim 16, wherein the glycol has a cloud point of at least 80° C.

61. The process of claim 23, wherein the glycol has a cloud point of at least 80° C.

62. The process of claim 39, wherein the glycol has a cloud point of at least 80° C.

63. A fibrous material obtained by a process comprising the steps of:

melt-spinning a thermoplastic resin comprising additives with spinning oil and forming a yarn; and replacing the additives and spinning oil contained in or attached to the spun yarn by treating the spun yarn with a glycol treatment containing an ethylene oxide adduct of glycol having a cloud point of at least 65° C.

64. A fibrous material for an ink-absorbing member holding an ink-jet ink, obtained by a process comprising the steps of:

melt-spinning a thermoplastic resin comprising additives with spinning oil and forming a yarn, the additives and spinning oil giving effect to ink-jet properties of the ink-jet ink; and treating the spun yarn with a glycol treatment containing an ethylene oxide adduct of glycol having a cloud point of at least 65° C., the treating step being performed so that the ink-jet ink is free from any effect of the additives and spinning oil.

65. A fibrous material for an ink-absorbing member holding an ink-jet ink, obtained by a process comprising the steps of:

melt-spinning a thermoplastic rein comprising additives with spinning oil and forming a yarn; and replacing the additives and spinning oil contained in or attached to the spun yarn by treating the spun yarn with a glycol treatment containing an ethylene oxide adduct of glycol having a cloud point of at least 65° C., and emulsifying the additives and spinning oil with the ethylene oxide adduct of glycol, so that the ink-jet ink is free from any effects of the additives and spinning oil.

66. The process according to claim 1, wherein the glycol treatment includes at least 70% glycol by weight.

67. The fibrous material according to claim 14, wherein the glycol treatment includes at least 70% glycol by weight.

68. The fibrous material according to claim 16, wherein the glycol treatment includes at least 70% glycol by weight.

69. The process according to claim 23, wherein the treating agent includes at least 70% glycol by weight.

70. An ink-absorbing member treated in accordance with the treatment process according to any one of claims 23 to 31 or 61.

71. The ink absorbing member according to claim 70, wherein the treating agent includes at least 70% glycol by weight.

72. The treating process according to claim 39, wherein the treating agent includes at least 70% glycol by weight.

73. The fibrous material according to claim 63, wherein the glycol treatment includes at least 70% glycol by weight.

74. The fibrous material according to claim 64, wherein the glycol treatment includes at least 70% glycol by weight.

75. The fibrous material according to claim 65, wherein the glycol treatment includes at least 70% glycol by weight.

* * * * *

UNITED STATES PATENT AND TRADEMARK OFFICE

CERTIFICATE OF CORRECTION

PATENT NO. : 6,815,381 B1 
DATED : November 9, 2004
INVENTOR(S) : Hajime Yamamoto et al.

It is certified that error appears in the above-identified patent and that said Letters Patent is hereby corrected as shown below:

Title page,
Item [54], Title, should read -- FIBROUS MATERIAL, PRODUCTION PROCESS OF THE FIBROUS MATERIAL, INK-ABSORBING MEMBER, TREATING PROCESS OF THE INK-ABSORBING MEMBER, INK CONTAINER AND INK CARTRIDGE --.

Column 1,
Line 3, "INK-ABSORBING," should read -- INK ABSORBING MEMBER, --; and
Line 35, "terephthal ate" should read -- terephthalate --.

Column 2,
Line 24, "rein" should read -- resin --.

Column 3,
Line 17, "im)" should read -- μm --.

Column 6,
Line 62, "65EC" should read -- 65°C --; and
Line 63, "80EC" should read -- 80°C --.

Column 7,
Line 13, "polychainhydrophobic" should read -- polychain-hydrophobic --; and
Line 49, "-CH2-" should read -- $-CH_2-$ --.

Column 9,
Line 65, "anfitiooxidants" should read -- antioxidants --.

Column 16,
Line 42, "50 im" should read -- 50 μm --.

Column 22,
Line 31, "90EC," should read -- 90°C, --.

Column 23,
Line 35, "COMPARATIVE EXAMPLE 2" should read -- COMPARATIVE EXAMPLE 1 --.

UNITED STATES PATENT AND TRADEMARK OFFICE

CERTIFICATE OF CORRECTION

PATENT NO. : 6,815,381 B1 
DATED : November 9, 2004
INVENTOR(S) : Hajime Yamamoto et al.

It is certified that error appears in the above-identified patent and that said Letters Patent is hereby corrected as shown below:

Column 25,
Line 8, “15 im” should read -- 15 μm --;
Line 9, “3 im” should read -- 3μm --;
Line 10, “21 im” should read -- 21 μm --;
Line 32, “g/cm3)” should read -- g/cm$^3$) --; and
Line 49, “60EC” should read -- 60°C --.

Column 27,
Lines 5 and 61, “133EC” should read -- 133°C --;
Line 6, “135EC to 155EC” should read -- 135°C to 155°C --;
Line 62, “135EC” should read -- 135°C --; and
Line 63, “155EC” should read -- 155°C --.

Column 28,
Line 11, “40 nm H 60” should read -- 40 mm x 60 --;
Line 12, “mm H 50” should read -- mm x 50 --, and “140EC” should read -- 140°C --;
Line 46, “45EC” should read -- 45°C --;
Line 58, “(15EC,” should read -- (15°C, --; and
Line 65, “155EC” should read -- 155°C --.

Column 29,
Line 9, “140EC” should read -- 140°C --.

Column 30,
Line 56, “160EC)” should read -- 160°C) --; and
Line 59, “g/cm3)” should read -- g/cm$^3$) --.

UNITED STATES PATENT AND TRADEMARK OFFICE

CERTIFICATE OF CORRECTION

PATENT NO. : 6,815,381 B1
DATED : November 9, 2004
INVENTOR(S) : Hajime Yamamoto et al.

It is certified that error appears in the above-identified patent and that said Letters Patent is hereby corrected as shown below:

Column 32,
Line 33, "40EC" should read -- 40°C --; and
Line 37, "60EC" should read -- 60°C --.

Signed and Sealed this

Fifth Day of July, 2005

JON W. DUDAS
*Director of the United States Patent and Trademark Office*